US007835676B2

(12) United States Patent
Goto et al.

(10) Patent No.: US 7,835,676 B2
(45) Date of Patent: Nov. 16, 2010

(54) DEVELOPING APPARATUS IMAGE FORMING APPARATUS, AND METHOD OF CHARGING A DEVELOPER USING CHARGING PARTICLES

(75) Inventors: Hiroshi Goto, Okazaki (JP); Chikara Tsutsui, Nishinomiya (JP); Takayuki Takai, Anjo (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 229 days.

(21) Appl. No.: 12/007,790

(22) Filed: Jan. 15, 2008

(65) Prior Publication Data

US 2008/0175625 A1 Jul. 24, 2008

(30) Foreign Application Priority Data

Jan. 16, 2007 (JP) ..... 2007-006720

(51) Int. Cl.
*G03G 15/09* (2006.01)

(52) U.S. Cl. ..... 399/270; 399/272

(58) Field of Classification Search ..... 399/267, 399/270, 272, 275–277; 430/110.4, 111.4, 430/122.1

See application file for complete search history.

(56) References Cited

U.S. PATENT DOCUMENTS 4,383,497 A 5/1983 Tajima
5,849,448 A 12/1998 Yoshino et al.
7,298,995 B2 * 11/2007 Mizobe ..... 399/272

FOREIGN PATENT DOCUMENTS

JP 56-40862 A 4/1981
JP 59-100472 A 6/1984
JP 04-067180 3/1992

(Continued)

OTHER PUBLICATIONS

Office Action in JP 2007-006720 dated Jan. 27, 2009.

(Continued)

*Primary Examiner*—Hoang Ngo
(74) *Attorney, Agent, or Firm*—Buchanan Ingersoll & Rooney PC

(57) ABSTRACT

A developing apparatus for visualizing an electrostatic latent image on an electrostatic latent image bearing member by using a developer including toner and carrier particles, has a developer including toner and carrier particles, a first transport member, a second transport member positioned to oppose to the first transport member across a first region and to the electrostatic latent image bearing member across a second region. A first electric field forming unit forms a first electric field between the first and second transport members to move the toner particles from the first transport member to the second transport member. A second electric field forming unit forms a second electric field between the second transport member and the electrostatic latent image bearing member to move the toner particles from the second transport member to the electrostatic latent image bearing member and thereby to visualize an electrostatic latent image on the image into a visible image. The developer further includes charging particles releasably retained on surfaces of the toner particles. Once released from the toner particles and then held on surfaces of the carrier particles, the third particles function to provide an electric charge of the first polarity to the toner particles by the contact therewith.

13 Claims, 19 Drawing Sheets

FOREIGN PATENT DOCUMENTS

| | | | |
|---|---|---|---|
| JP | 9-269614 | A | 10/1997 |
| JP | 2003-215855 | A | 7/2003 |
| JP | 2004-302360 | | 10/2004 |
| JP | 2006-065317 | | 3/2006 |
| JP | 2006-098816 | | 4/2006 |
| JP | 2006-308687 | A | 11/2006 |

OTHER PUBLICATIONS

English Language Translation of Japanese Office Action in corresponding Patent Application No. 2007-006720 dated Jan. 27, 2009.

Notice of Preliminary Rejection issued in corresponds Japanese Application No. 2007-006720 dated Oct. 6, 2009, and an English Translation thereof.

* cited by examiner $$\text{MINUS DUTY RATIO} = \frac{t1}{t1+t2} \times 100[\%]$$

DEVELOPING APPARATUS IMAGE FORMING APPARATUS, AND METHOD OF CHARGING A DEVELOPER USING CHARGING PARTICLES

FIELD OF THE INVENTION

The present invention relates to an electrophotographic image forming apparatus and a developing device for use in the image forming apparatus. The present invention also relates to a method of charging a developer in an electrophotographic image forming apparatus.

BACKGROUND OF THE INVENTION

Conventionally, there has been known two types of developing processes for use in the electrophotographic image forming apparatus; a single-component developing method using only toner as a principal component of the developer and a two-component developing method using toner and carrier in combination as principal components of the developer.

The developing device of the single-component developing method has a toner transporting member which transports toner and a frictional charging member which contacts with a toner transporting surface of the toner transporting member. With this arrangement, the toner transported by the toner transporting member is brought into the contact region of the frictional charging member, where it is formed into a thinned layer of toner charged with a certain polarity. Since the single-component development system charges the toner through the contact with the frictional charging member, the developing device has a simple and compact structure and therefore may be constructed economically. Contrarily, the toner is subjected to a strong stress in the contact region of the frictional charging member, which can damage the toner and deteriorate its charging ability in a short period of time. Also, the toner can adhere to the toner transporting member and/or the frictional charging member due to the contact pressure, which reduces charging abilities of those members and, as a result, shortens the life of the developing device.

Typically, the developing device using the two-component developing method causes the toner and the carrier to be charged into opposite polarities through the frictional contacts thereof. Therefore, the stress exerted on the toner is less than that in the developing device of the single-component developing method. Also, the carrier has a larger surface area than the toner, which provides less contamination to the carrier by the possible adhesion of the toner. However, an amount of toner fixed on the surface of the carrier, called toner-spent, increases with a mixing time, which in turn reduces the charging ability against the toner and causes problems such as unwanted fog-like toner adhesion onto the resultant image and/or scattering of the insufficiently charged toner into the air. It may be thought that the life of the two-component developing device be extended by increasing an amount of carrier contained in the developing device. Disadvantageously, this results in a considerable increase in size of the developing device.

In order to solve the problems described for the two-component developing device, JP 59-100472 A discloses a developing device in which an increase of deteriorated carrier is restricted by supplying new carrier only or new carrier and toner in combination to the developer while discharging a part of the deteriorated developer, intermittently. This, indeed, extends the life of the developer without increasing the size of the developing device but, disadvantageously, needs a mechanism for collecting the discharged carrier and also uneconomically wastes a considerable amount of carrier, which can cause an environmental problem. Further, a considerable number of printings are required to establish a predetermined ratio between not-deteriorated and deteriorated carriers.

JP 09-269614 A discloses a carrier and an image forming method using the carrier, in which each particle of carrier has a core material and a resin layer covering the core, the layer being made of a matrix resin and electrically conductive small particles dispersed in the matrix resin. In use, even if a portion or portions of the surface of this carrier are chipped off by the contact with other particles such as carrier particles and toner particles and/or components such as roller and screw, the underlying resin particles are alternatively exposed at the surface of the carrier, so that they make contacts with the toner to provide the toner with a necessary electric charge. However, a thickness of a resin cover layer is limited and then, once the layer is consumed, the carrier reaches the end of its life.

JP 2003-215855 A discloses a two-component developer comprising a carrier and a toner which carries chargeable particles on the surface thereof and an image forming method using the developer. The charging particles function as polishing material for removing the toner-spent which is the adhesion of the toner onto the carrier and thereby extending the life of the carrier. JP 2003-215855 Also discloses that the charging particle polishes the surface of an electrostatic latent image bearing member in the region for cleaning the bearing surface of the electrostatic latent image bearing member. Disadvantageously, the charging particle tends to be electrically charged into a polarity which is different from the polarity provided to the toner. This results in that the charging particle is likely to adhere to a region outside the image forming region, i.e., non-image forming region, of the electrostatic latent image bearing member and then consumed in a short period of time. In particular, a production of a number of images each with smaller image portions such as text images wastes a great amount of charging particles to restrict the polishing and the resultant reproduction characteristics of the carrier.

JP 2006-308687 A discloses an image forming apparatus having a developing device with a magnetic roller and a developing roller. The magnetic roller supports a developing material including toner and carrier. The carrier is magnetically retained on the magnetic roller and electrically holds the toner which is selectively provided to the developing roller for the development of the electrostatic latent images on the electrostatic latent image bearing member into visualized images. In particular, the developer also includes the charging particles existing but not electrically or magnetically retained between toner and carrier particles to prevent the unwanted adhesion of the toner and thereby the generation of the toner-spent on the carrier. The charging particles, however, are contained only in the toner initially introduced into the developing device and also consumed gradually with the consumption of the toner, due to the electrical connection with the toner, and supplied through the developing roller to the non-image forming region of the electrostatic latent image bearing member. As a result, a mass production of the image with a smaller image region or black-to-white ratio such as text image causes a considerable amount of charging particles to be wasted and thereby fails to ensure a long term, stable electric charging of the toner.

SUMMARY OF THE INVENTION

Therefore, it is an object of the present invention to provide a developing device and an image forming apparatus capable of providing a long-term stable toner-charging property to the carrier of the two-component developer.

In order to achieve the foregoing object, the present invention provides a developing device. The developing apparatus has a developer including toner and carrier particles, a first transport member, a second transport member positioned to oppose to the first transport member across a first region and to the electrostatic latent image bearing member across a second region. A first electric field forming unit forms a first electric field between the first and second transport members to move the toner particles from the first transport member to the second transport member. A second electric field forming unit forms a second electric field between the second transport member and the electrostatic latent image bearing member to move the toner particles from the second transport member to the electrostatic latent image bearing member and thereby to visualize an electrostatic latent image on the image into a visible image. The developer further includes charging particles releasably retained on surfaces of the toner particles. Once released from the toner particles and then held on surfaces of the carrier particles, the third particles function to provide an electric charge of the first polarity to the toner particles by the contact therewith.

According to the present invention, the first particles in the developing apparatus is provided with a stable amount of electric charge through frictional contacts with the third particles held on the second particles. Accordingly, the developing device and the image forming apparatus that incorporate the present invention can form images having an elevated quality over the long term.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
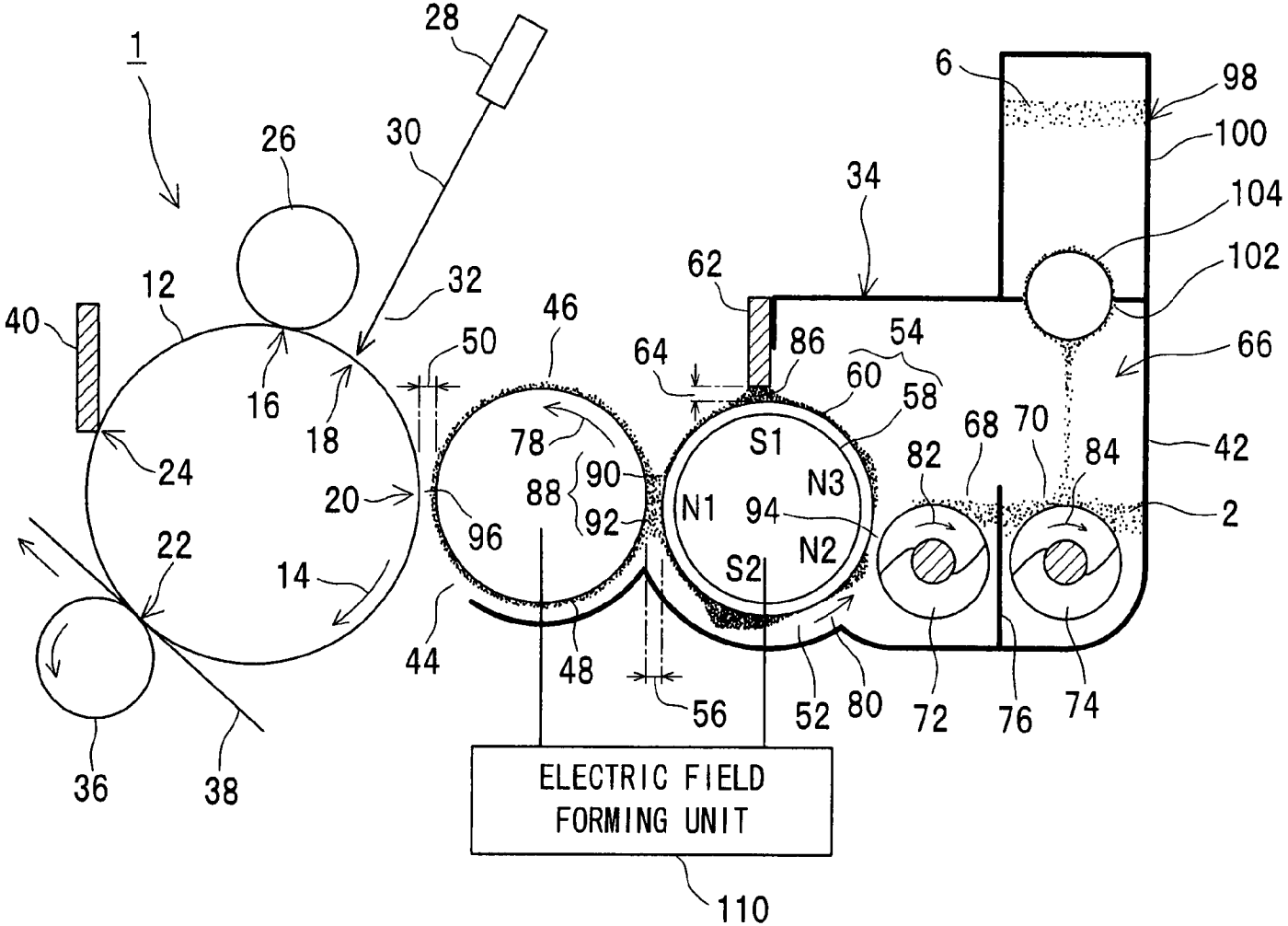
FIG. 1 is a schematic cross sectional view showing a schematic construction of an image forming apparatus according to an embodiment of the present invention and a developing apparatus of an embodiment according to the present invention.

The following descriptions of the preferred embodiments are merely exemplary in nature and are in no way intended to limit the invention, its application, or uses.

Hereinafter, preferred embodiments of the present invention will be described with reference to the accompanying drawings. In the following description, terms referring to specific directions (for example, "up", "down", "left", "right", and other terms including one of those terms in combination, and "clockwise" and "counterclockwise") will be used. It should be noted that these terms are used for the purpose of facilitating the understanding of the invention taken in conjunction with the drawings and meanings of these terms should not be construed as restricting the present invention. Also, in an image forming apparatus and developing device described below, like reference numerals indicated like parts throughout the specification.

1. Image Forming Apparatus

FIG. 1 shows a part of the electrophotographic image forming apparatus, including components relating to an image formation by the apparatus. The image forming apparatus may be any one of a copy machine, a printer, a facsimile, and a multi-function peripheral including functions thereof in combination. The image forming apparatus generally indicated at 1 has a photosensitive member 12 for bearing an electrostatic latent image thereon. In this embodiment, the photosensitive member 12 is made of a cylindrical member in the form of drum. It should be noted that the present invention is not limited to use the photosensitive drum and another photosensitive member in the form of endless belt, for example, may be used instead. The photosensitive member 12 is drivingly connected to a motor (not shown) so that it rotates in the direction shown by arrow 14 by the driving of the motor. Disposed around the photosensitive member 12 are a charging station 16, an exposure station 18, a development station 20, a transfer station 22, and a cleaning station 24, along the rotational direction of the photosensitive member 12.

The charging station 16 includes charging device 26 which charges a photosensitive layer, or a peripheral surface of the photosensitive member 12, to a predetermined voltage. In the embodiment, the charging device 26 is shown in the form of a cylindrical roller. Alternatively, another charging devices in the form of, for example, rotatable or unrotatable roll brush and wire, can also be used. The exposure station 18 has a passage 32 through which an exposure device 28 provided adjacent to or away from the photosensitive member 12 projects image light 30 onto the outer peripheral surface of the photosensitive member 12 to form an electrostatic latent image. The electrostatic latent image has a portion or portion exposed to the light and thereby decreased in voltage and a portion or portions not exposed to light and thereby maintaining substantially the charged voltage. In the embodiment, the voltage-decreased portion is the imaging portion and the voltage-maintained portion is the non-imaging portion. The development station 20 has developing device 34 which visualizes the electrostatic latent image using a powder developer. The details of the developing device 34 will be described later. The transfer station 22 has transfer device 36 which transfers the visualized images formed on the peripheral surface of the photosensitive member 12 onto a sheet 38 such as paper and films. In the embodiment, the transfer device 36 is shown in the form of a cylindrical roller. Alternatively, the transfer device using a wire may be used. The cleaning station 24 has cleaning device 40 which collects the untransferred toner remaining on the peripheral surface of the photosensitive member 12 without being transferred to the sheet 38 at the transfer station 22. In the embodiment, the cleaning device 40 is shown in the form of blade made of plate. Alternatively, another type of cleaning device in the form of, for example, rotatable or unrotatable brush roll may be used.

In operation of the image forming apparatus 1 so constructed, the photosensitive member 12 rotates in the clockwise direction by the driving of the motor (not shown) Incremental portions of the photosensitive member passing through the charging station 16 are electrically charged to a predetermined voltage by the charging device 26. The charged peripheral portion of the photosensitive member is exposed to the image light 30 at the exposure station 18 to form an electrostatic latent image. The electrostatic latent image is transported to the development station 20 with the rotation of the photosensitive member 12, where it is visualized into a visual image using powder developer material by the developing device 34. The visualized developer image is transported to the transfer station 22 with the rotation of the photosensitive member 12, where it is transferred to the sheet 38 by the transfer device 36. The sheet 38 supporting the developer image is transported to a fixing station (not shown) where the developer image is permanently fixed to the sheet 38. The peripheral portion of the photosensitive member passing through the transfer station 22 is transported to the cleaning station 24 where the untransferred developer remaining on the peripheral surface of the photosensitive member 12 is collected.

2. Developing Device

The developing device 34 includes a container or housing 42 which accommodates a two-component developer containing a first component or nonmagnetic toner particles and a second component or magnetic carrier particles. The housing accommodates various members which will be described below. For the simplification of the drawing, a part of the housing 42 is omitted therefrom. The housing 42 has an opening 44 opened toward the photosensitive member 12. A developing roller 48 serving as a toner transport member (a second transport member) is provided in a space 46 formed adjacent the opening 44. The developing roller 48, which is made of a cylindrical member (a second cylindrical member), is rotatably disposed in parallel with the photosensitive member 12 so that a constant development gap 50 is defined between the peripheral surface of the photosensitive member 12 and the opposed peripheral surface of the developing roller 48.

Provided on the back (right side in the drawing) of the developing roller 48 is another space 52 for receiving a transporting roller 54 or developer transport member (a first transport member) in parallel with the developing roller 48 so that a certain supplying and collecting gap 56 is defined between the opposed peripheral surfaces of the developing roller 48 and the transporting roller 54. The transporting roller 54 has a magnet 58 unrotatably fixed and a cylindrical sleeve 60 (a first cylindrical member) supported for rotation around the magnet 58. A regulating plate 62 is secured to the housing 42 so that it extends substantially in parallel with a longitudinal central axis of the sleeve 60 to define a regulating gap 64 between the peripheral surface of the sleeve 60 and the distal end of the regulating plate 62 opposing thereto.

The magnet 58 has a plurality of magnetic poles each opposing to the inner peripheral surface of the transporting roller 54 and extending radially outwardly from the central axis of the transporting roller 54. In the embodiment, the magnet 58 includes a magnetic pole S1 opposed to the upper inner surface portion of the transporting roller 54 adjacent the regulating plate 62, a magnetic pole N1 opposed to the left side inner surface portion of the transporting roller 54 adjacent the supplying and collecting gap 56, and a magnetic pole S2 opposed to the lower inner surface portion of the transporting roller 54, and two neighboring magnetic poles N2 and N3 having the same polarity and opposed to the right side inner surface portion of the transporting roller 54.

A developer mixing chamber 66 is provided on the back of the transporting roller 54. The mixing chamber 66 has a front chamber 68 positioned adjacent the transporting roller 54 and a rear chamber 70 positioned away from the transporting roller 54. A front screw 72 or front mixing and transporting member for mixing and transporting the developer in a direction extending from the front surface to the rear surface of the drawing sheet is rotatably mounted in the front chamber 68, and a rear screw 74 or a rear mixing and transporting member for mixing and transporting the developer in the opposite direction is also rotatably mounted in the rear chamber 70. As shown in drawing, the front chamber 68 and the rear chamber 70 may be separated by a partition 76 provided between the front and rear chambers. In this embodiment, portions of the partition in the vicinity of the opposite ends of the front chamber 68 and the rear chamber 70 are removed to form passages (not shown) so that the chambers 68 and 70 are communicated through the passages with each other to feed the developer reached the downstream end of one chamber into the upstream end of the other chamber and vice versa.

Figure 2:
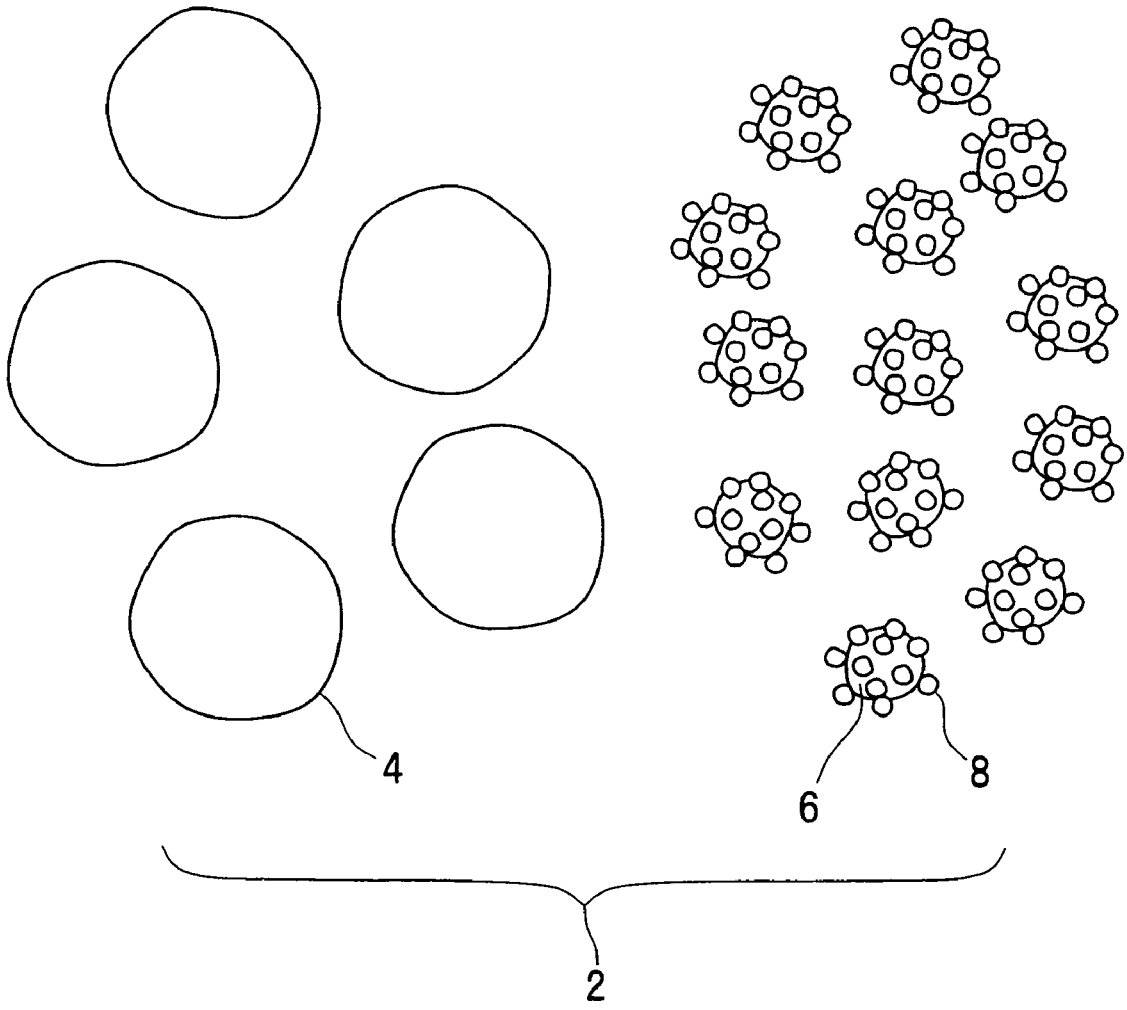
FIG. 2 is a schematic view illustrating particles included in a developer.
Figure 3:
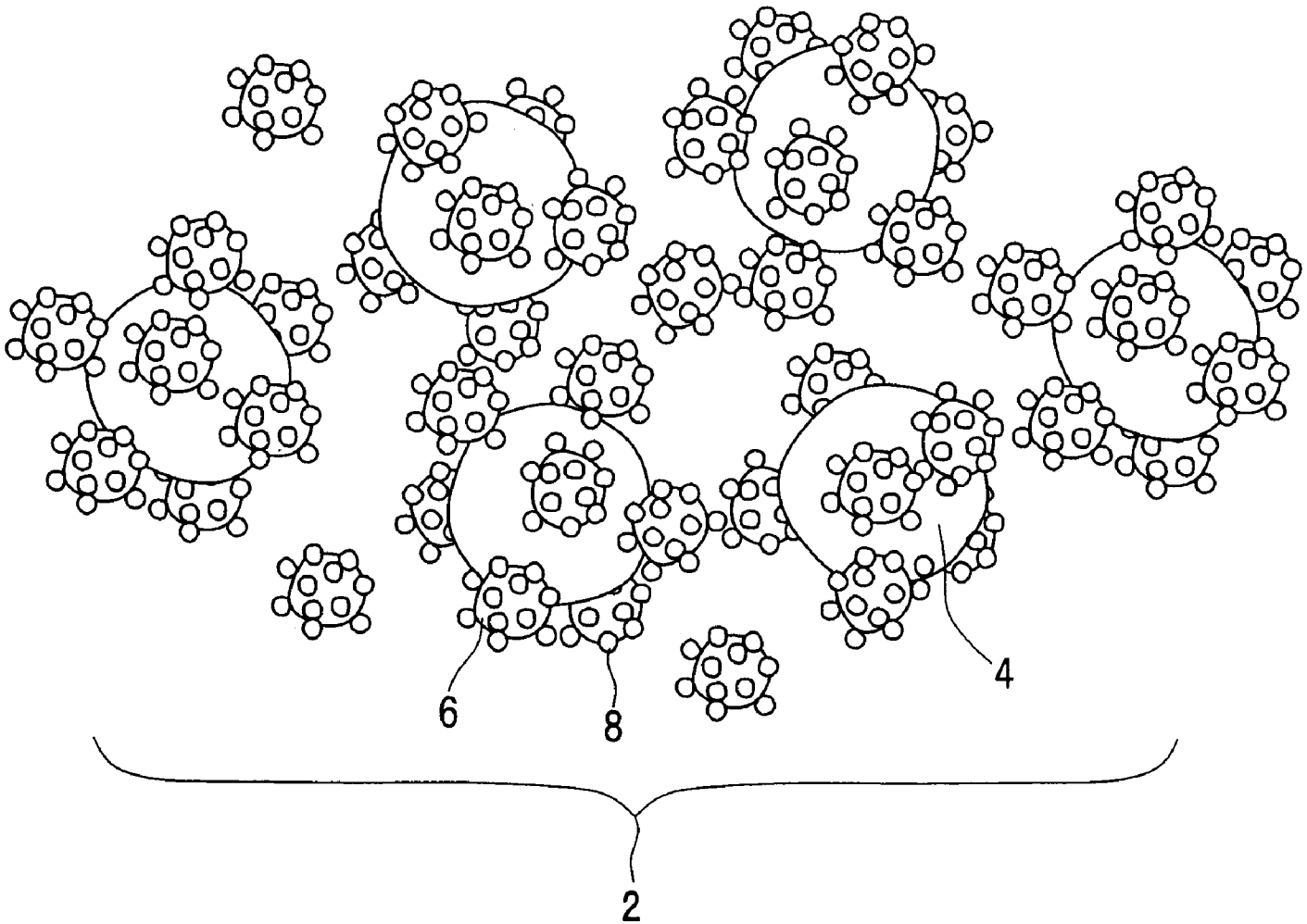
FIG. 3 is a schematic view illustrating the particles in which toner particles retaining charging particles are retained on surfaces of carrier particles.

In operation of the developing device 34 so constructed, the developing roller 48 and the sleeve 60 rotate in the directions indicated by arrows 78, 80, respectively, by the driving of the motor (not shown). The front screw 72 rotates in the direction of arrow 82 and the rear screw 74 rotates in the direction of arrow 84. This allows that developer 2 accommodated in the developer mixing chamber 66 is mixed and circulated between the front and rear chambers 68 and 70. Consequently, the toner and carrier particles included in the developer make frictional contacts with each other to be electrically charged with different polarities. In the embodiment, it is assumed that the carrier particles are positively charged and the toner particles are negatively charged. As shown in FIG. 2, typically the carrier particle 4 is considerably larger than the toner particle 6. Accordingly, as shown in FIG. 3, the toner particle 6 negatively charged is electrically attracted to the periphery of positively charged carrier particle 4.

Referring back to FIG. 1, the charged developer 2 is supplied to the transporting roller 54 as it is transported in the front chamber 68 by the front screw 72. The developer 2 supplied from the front screw 72 to the transporting roller 54 is caught on the peripheral surface portion of the sleeve 60, adjacent the magnetic pole N3, by the magnetic force of the magnetic pole N3. The developer 2 on the sleeve 60 constitutes magnetic brushes each extending along the magnetic lines of force formed by the magnet 58 and is then transported in the counterclockwise direction with the rotation of the sleeve 60. The developer 2 is then transported to a regulating region 86 where the regulating plate 62 opposes the sleeve 60. In the regulating region 62, the developer 2 magnetically held by the magnetic pole S1 is restricted by the regulating plate 62, so that an amount of the developer 2 to be passed through the gap 64 is limited substantially to a predetermined amount. The developer 2 passed through the regulating gap 64 is then transported to the region (supplying and collecting region) 88 where the developing roller 48 is opposed to the transporting roller 54 and the magnetic pole N1. As described in detail later, the supplying and collecting region 88 includes a supplying sub-region 90 and a collecting sub-region 92 positioned on the downstream side of the supplying sub-region 90 in the rotational direction of the sleeve 60. In the supplying sub-region 90, the toner particles 6 electrically retained on the carrier particles 4 are supplied to the developing roller 48 by the electric field formed between the developing roller 48 and the sleeve 60. In the collecting sub-region 92, the toner particles 6 on the developing roller 48 returned to the supplying and collecting region 88 without being transferred to the photosensitive member 12 for development is scraped off by the magnetic brushes extending along the magnetic lines of force of the magnetic pole N1 and collected to the sleeve 60. The carrier particles 4 are retained on the peripheral surface of the sleeve 60 by the magnetic force of the magnet 58 so that they do not transfer from the sleeve 60 to the developing roller 48. The developer 2 passed through the supplying and collecting region 88 is then held by the magnetic force of the magnet 58 to pass beyond the region opposing the magnetic pole S2 with the rotation of the sleeve 60. Then the developer 2 is transported into a region (discharge region 94) located between the magnetic pole N2 and the magnetic pole N3, where it is released from the peripheral surface of the sleeve 60 into the front chamber 68 by a repellent magnetic field formed by the magnetic poles N2 and N3 and then mixed in the developer 2 being transported in the front chamber 68.

The toner particles 6 held on the developing roller 48 in the supplying sub-region 90 is transported in the counterclockwise direction with the rotation of the developing roller 48 into a region (development region) 96 defined between the photosensitive member 12 and the opposing developing roller 48, where they are transferred to the electrostatic latent image region on the peripheral surface of the photosensitive member 12.

In the embodiment, a negative voltage $V_H$ is imparted to the peripheral surface of the photosensitive member 12 by the charging device 26. Typically, the charged region of the photosensitive member 12 is partially exposed to the image light 30 to form the electrostatic latent image including the image region with a surface voltage $V_L$ decreased by the exposure to the image light 30 and the non-image region with a surface voltage $V_H$ substantially identical to the original charged voltage. This results in that, in the development region 96, the negatively charged toner particles 6 adhere to the electrostatic latent image region with an aid of the electric field formed between the photosensitive member 12 and the developing roller 48 to visualize the electrostatic latent image.

The toner particles 6 are supplied to the developer 2. Preferably, the amount of toner particles 6 to be supplied substantially corresponds to that consumed by the development. To this end, the developing device 34 includes means for measuring a mixed ratio between amounts of toner and carrier particles in the housing 42. Also, a toner supply unit 98 is mounted above the rear chamber 70. The toner supply unit 98 has a container 100 for accommodating the toner particles. An opening 102 is formed at the bottom of the container 100, in which a supply roller 104 is disposed. The supply roller 104 is drivingly connected to a motor (not shown) so that the motor drives the supply roller 104 when the measurement of the mixing ratio between the toner and carrier particles to supply supplemental toner particles into the rear chamber 70.

3. Electrical Field Forming Unit

In order to make an effective transfer of the toner particles 6 from the sleeve 60 to the developing roller 48 in the supplying sub-region 90, the developing roller 48 and the sleeve 60 are electrically connected to an electric field forming unit 110 which is illustrated in FIGS. 5A to 9, for example.

Figure 5A:
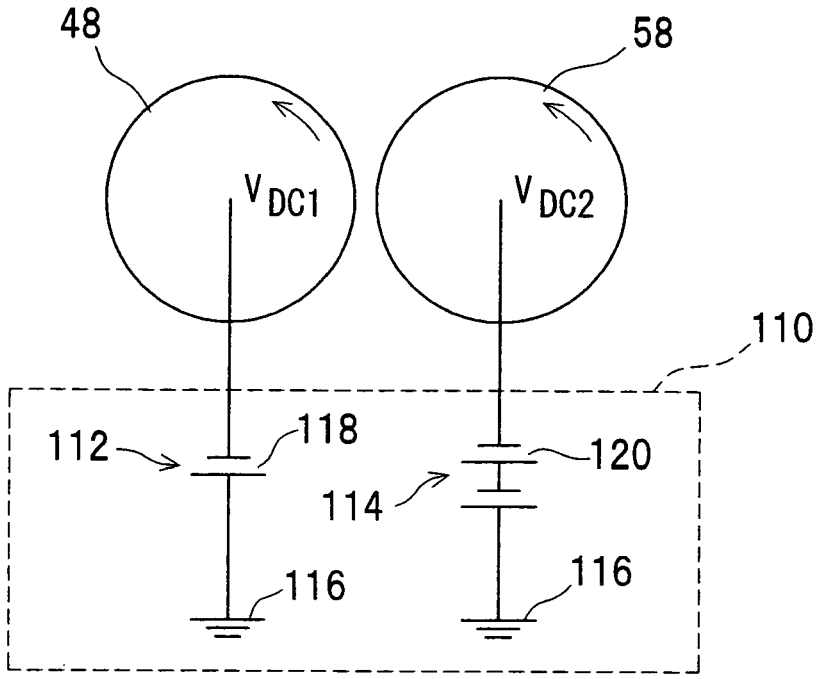
FIG. 5A is a diagram showing an embodiment of electric field forming unit.
Figure 5B:
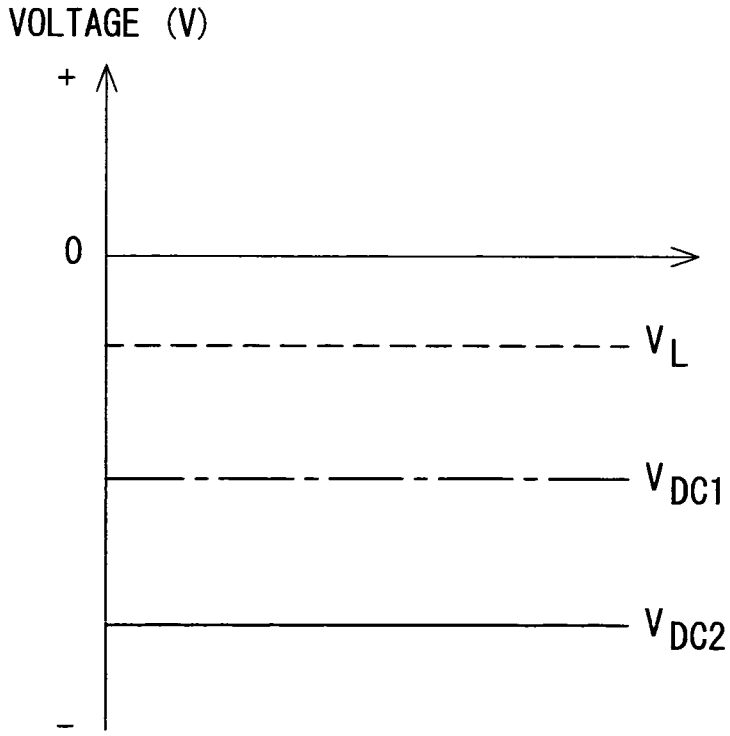
FIG. 5B is a view showing a relationship between voltages supplied from the electric field forming unit shown in FIG. 5A to a sleeve and a development sleeve.

An embodiment of the electric field forming unit 110 in FIG. 5A has a first power supply 112 corresponding to a second electric field forming unit in the claims and connected to the developing roller 48 and a second power supply 114 corresponding to a first electric field forming unit in the claims and connected to the sleeve 60. The first power supply 112 has a DC power supply 118 connected between the developing roller 48 and ground 116 for applying the developing roller 48 with a first DC voltage $V_{DC1}$, for example, −200 volts. The voltage $V_{DC1}$ has the same polarity as the charged polarity of the toner particles 6. The second power supply 114 has a DC power supply 120 connected between the sleeve 60 and ground 116 for applying to the sleeve 60 with a second DC voltage $V_{DC2}$, for example, −400 volts. The voltage $V_{DC2}$ has the same polarity as the charged polarity of the toner particles 6 is set to be higher than the first DC voltage $V_{DC1}$ (see FIG. 5B). This results in that, in the supplying sub-region 90, the negatively charged toner particles 6 are subjected to the DC electric field formed between the developing roller 48 and the sleeve 60 and are electrically attracted from the sleeve 60 to the developing roller 48. At this moment, the positively charged carrier particles 4 are not attracted from the sleeve 60 to the developing roller 48. Also, in the development region 96, the negatively charged toner particles 6 held on the developing roller 48 adhere to the electrostatic latent image region based on the voltage difference between the developing roller 48 ($V_{DC1}$: −200 V) and the electrostatic latent image region ($V_L$: −80 V) as shown in FIG. 5B. Also, the negatively charged toner particles 6 are retained on the developer roller 48 due to the voltage difference between the developing roller 48 ($V_{DC1}$: −200 V) and the electrostatic latent non-image region ($V_H$: −600 V).

Figure 6A:
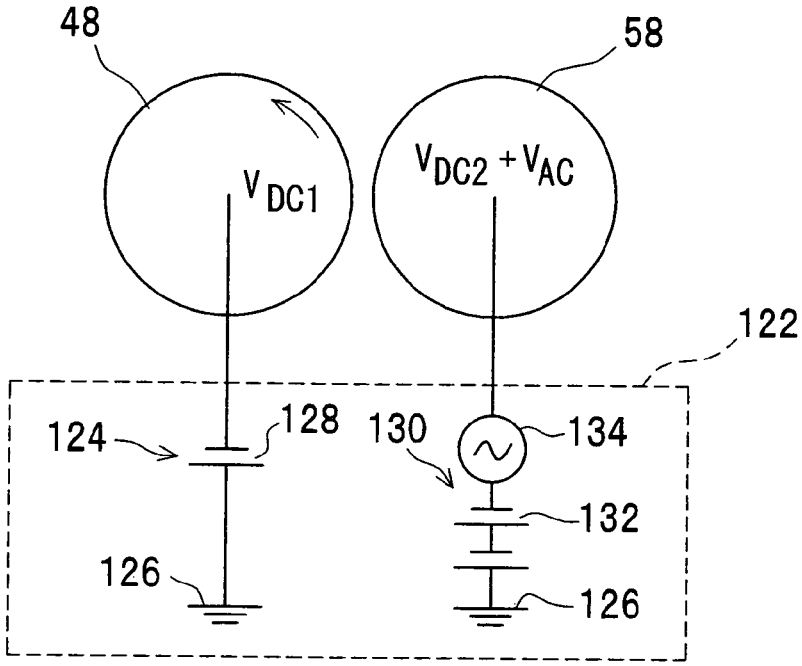
FIG. 6A is a diagram showing another embodiment of electric field forming unit.

FIG. 6A shows a second embodiment of the electric field forming unit 122. In this embodiment, the first power supply 124 has a DC power supply 128 connected between the developing roller 48 and ground 126, similar to the first embodiment, for applying the developing roller 48 with the first DC voltage $V_{DC1}$, for example, −200 volts. The voltage $V_{DC1}$ has the same polarity as the charged polarity of the toner particles 6. The second power supply 130 has a DC power supply 132 and an AC power supply 134 between the sleeve 60 and ground 126. The DC power supply 132 is adapted to apply the sleeve 60 with a second DC voltage $V_{DC2}$, for example, −400 V. The voltage $V_{DC2}$ has the same polarity as the charged polarity of the toner particles 6 and is set to be higher than the first DC voltage $V_{DC1}$.

Figure 6B:
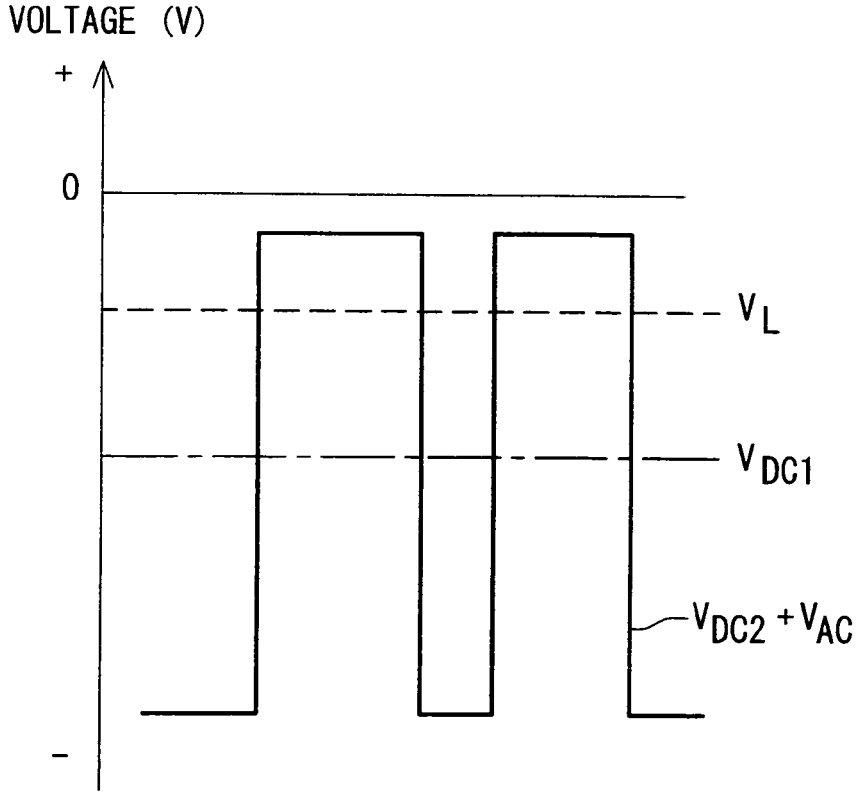
FIG. 6B is a view showing a relationship between voltages supplied from the electric field forming unit shown in FIG. 6A to a sleeve and a development sleeve.

As shown in FIG. 6B, the AC power supply 134 applies an alternating voltage $V_{AC}$ with a peak-to-peak voltage $V_{P-P}$ of, for example, 300 volts. This results in that, in the supplying sub-region 90, the negatively charged toner particles 6 are subjected to the a pulsative electric field formed between the developing roller 48 and the sleeve 60 to be electrically attracted from the sleeve 60 to the developing roller 48. At this moment, the positively charged carrier particles 4 are held on the sleeve 60 by a magnetic force of the magnet fixed within the sleeve 60 without being supplied to the developing roller 48. Also, in the development region 96, the negatively charged toner particles 6 held on the developing roller 48 adhere to the electrostatic latent image region due to the voltage difference between the developing roller 48 ($V_{DC1}$: −200 V) and the electrostatic latent image region ($V_L$: −80 V).

Figure 7A:
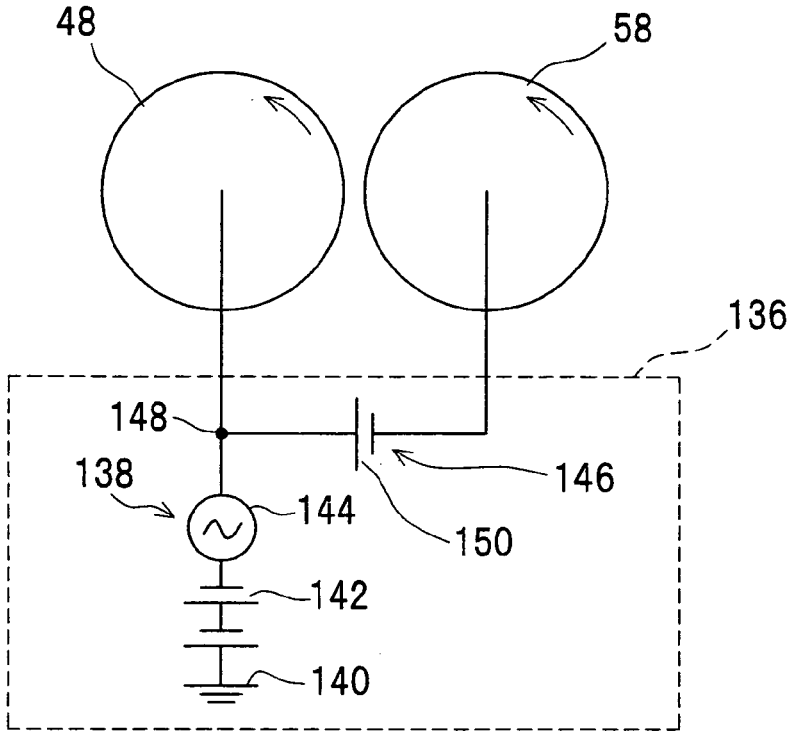
FIG. 7A is a diagram showing another embodiment of electric field forming unit.
Figure 7B:
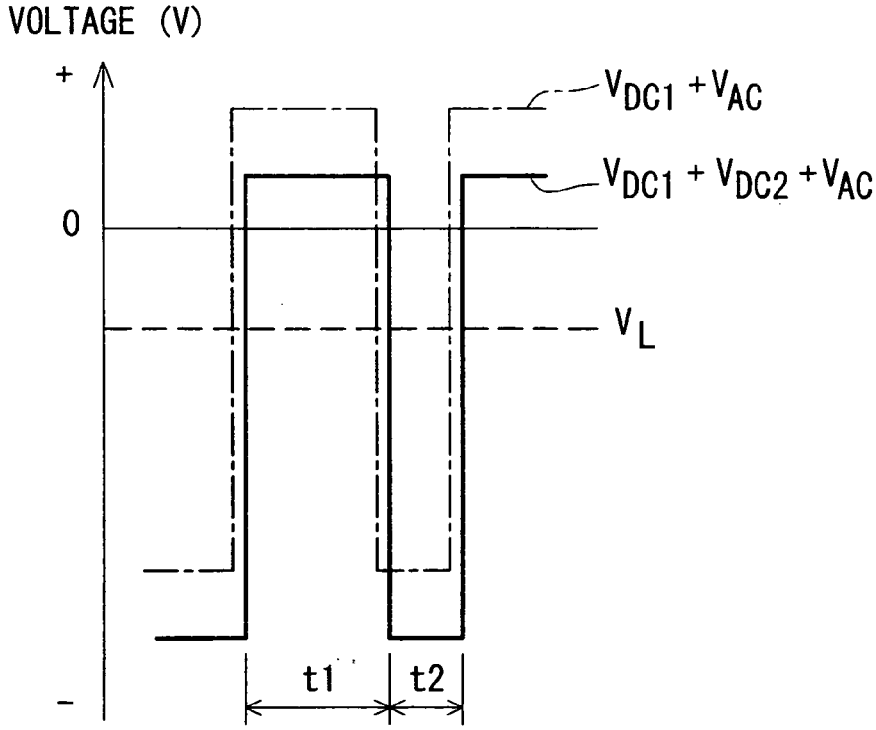
FIG. 7B is a view showing a relationship between voltages supplied from the electric field forming unit shown in FIG. 7A to a sleeve and a development sleeve.

FIG. 7A shows a third embodiment of the electric field forming unit 136. In this embodiment, the first power supply 138 has a DC power supply 142 and an AC power supply 144 between the developing roller 48 and ground 140. The DC power supply 142 applies the developing roller 48 with a first DC voltage $V_{DC1}$, for example, −200 V. The voltage $V_{DC1}$ has the same polarity as the charged polarity of the toner particles 6. The AC power supply 144 applies an alternating voltage $V_{AC}$ with an amplitude or peak-to-peak voltage $V_{P-P}$ of, for Example 1600 volts, between the developing roller 48 and the ground 140. The second power supply 146 has a DC power supply 150 connected between a terminal 148 positioned between the developing roller 48 and the AC power supply 144 and the sleeve 60. The DC power supply 150, which is designed to output a predetermined DC voltage $V_{DC2}$, has an anode connected to the terminal 148 and a cathode connected to the sleeve 60 so that the sleeve 60 is negatively biased relative to the developing roller 48 (see to FIG. 7B).

Accordingly, in the supplying sub-region 90, the negatively charged toner particles 6 are subjected to the pulsative electric field formed between the developing roller 48 and the sleeve 60 and are electrically attracted from the sleeve 60 to the developing roller 48. Also, in the development region 96, the negatively charged toner particles 6 held on the developing roller 48 adhere to the electrostatic latent image region due to the voltage difference between the developing roller 48 ($V_{DC1}$: −200 V) and the electrostatic latent image region ($V_L$: −80 V).

Figure 8:
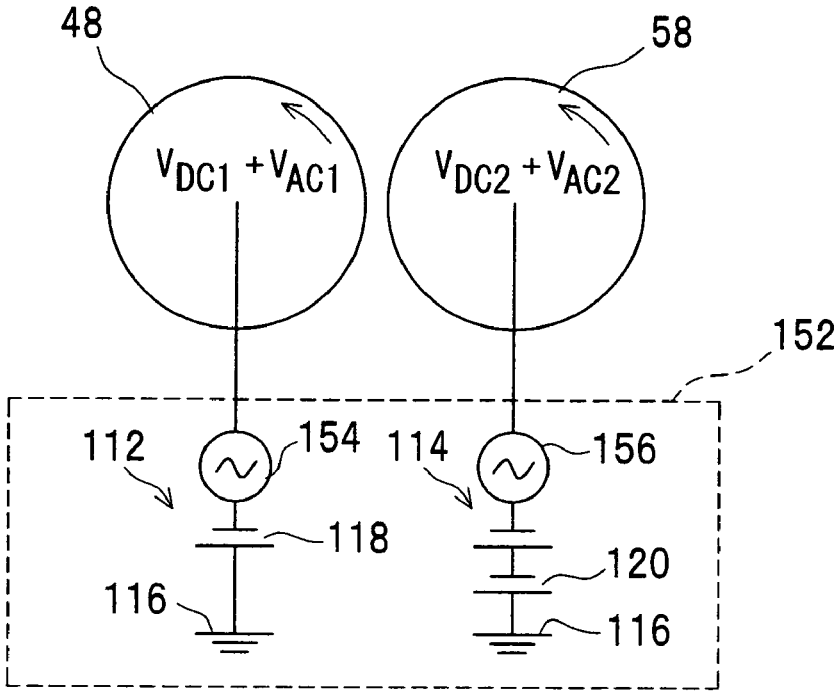
FIG. 8 is a diagram showing another embodiment of electric field forming unit.
Figure 9:
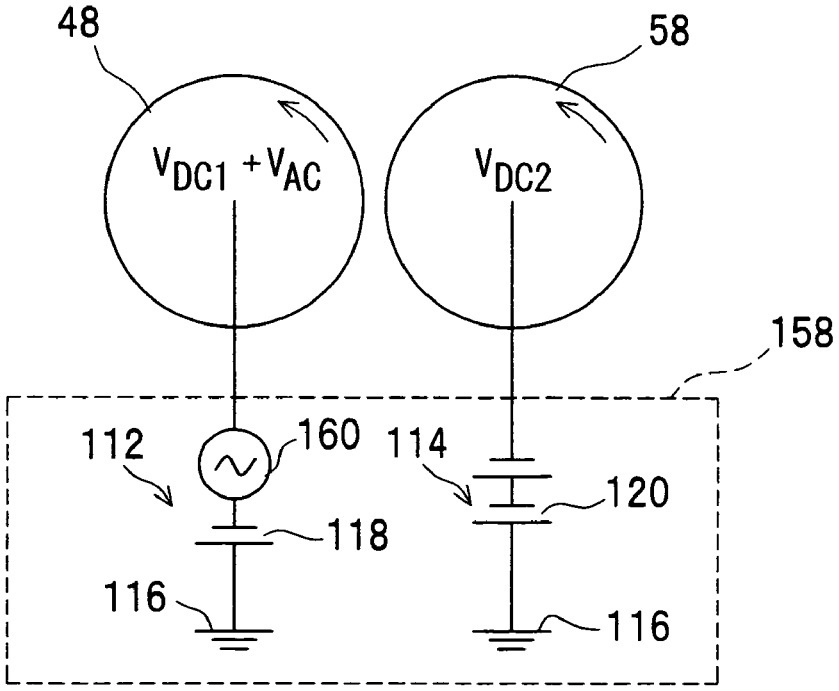
FIG. 9 is a diagram showing another embodiment of electric field forming unit.

FIG. 8 shows a third embodiment of the electric field forming unit 152. In this embodiment, AC power supplies 154 and 156 are added in the first and second power supplies 112 and 114, respectively, and connected serially with the DC power supplies 118 and 120, respectively. The output voltages $V_{AC1}$ and $V_{AC2}$ of the AC power supplies 154 and 156 may be identical to or different from each other. FIG. 9 shows a fourth embodiment of the electric field forming unit 158. In this unit 158, AC power supply 160 with an output voltage $V_{AC}$ is added to the first power supply 112. According to the embodiments, a pulsative electric field is formed in the supplying and collecting region 88 and also in the developing region 96, so that the negatively charged toner particles 6 are efficiently supplied from the sleeve 60 to the developing roller 48 and then to the image region ($V_L$: −80 V) of the photoconductive member 12.

4. Developer

One of the disadvantages in using two-component developer including toner and carrier particles is that the toner particle or particles permanently adhere to the surface of the carrier particles to cause so-called toner-spent which would reduce the life of the carrier particles. In order to overcome this problem, charging particles (implant particles) are added in the two-component developer as a third component of the developer in the embodiments of the image forming apparatus of the present invention.

Figure 4:
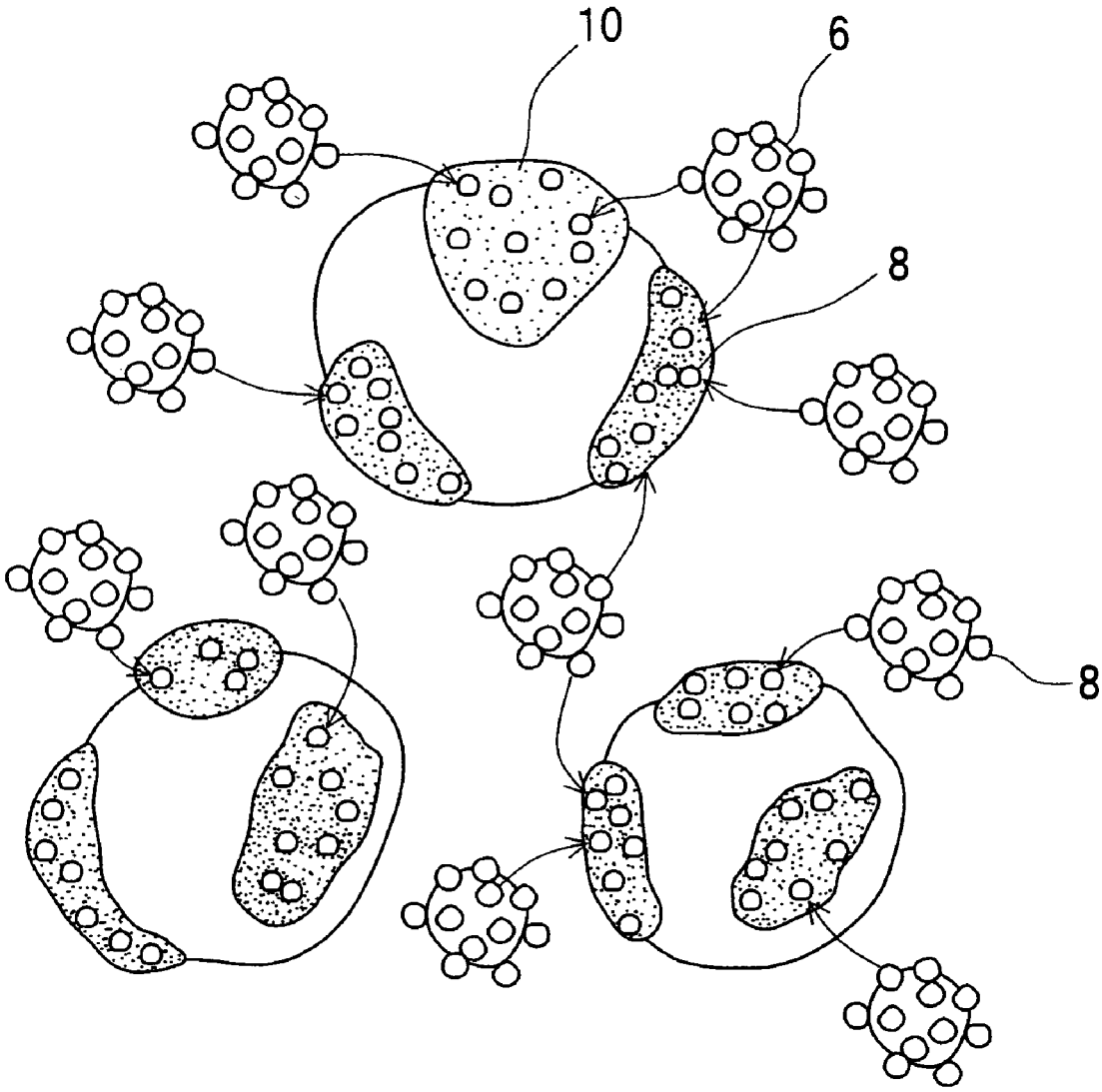
FIG. 4 is a schematic view illustrating a particles in which the charging particles are implanted into toner spent on the carrier particles.

As best shown in FIGS. 2 to 4, the developing device of the image forming apparatus accommodates not only toner and carrier particles 6 and 4 but also charging particles 8, each far smaller in diameter than the toner particle 6. The charging particles 8 are capable of providing toner particles 6 with an electric charge of normal polarity, i.e., negative polarity in the embodiment, through the frictional contacts with the toner particles 6. In particular, the charging particles 8 are releasably retained on the outer surfaces of the toner particles 6. Preferably, the charging particles 8 are also supplied from the toner supplying unit 98, together with the toner particles 6.

In the image forming operation, the charging particles 8 are transported together with the toner and carrier particles 6 and 4 within the housing 42. Also, the charging particles 8 are provided onto the sleeve 60 and transported through the regulating region 86, the supplying and collecting region 88, and the discharge region 94. In this transportation process, the charging particle 8 are positively charged by the contacts with toner particles 8 and then supported on the negatively charged toner particles 6. When the positively charged charging particles 8 are placed in the electric field formed in the supplying and collecting region 88, they are electrically forced in a direction opposite to the electric force acting on the toner particles 6 to separate from the toner particles 6. Subsequently, the separated charging particle 8 are in turn held on or implanted into the peripheral surface of the carrier particles 4 by the stress acting between the separated charging particle 8 and the carrier particles 4. In particular, as shown in FIG. 4, if the peripheral surface of the carrier particle 4 is covered partially or entirely with the toner-spent 10, the charging particle 8 is implanted into the toner-spent 10. The charging particles 8 held or implanted on the peripheral surfaces of the carrier particles 4 are electrically charged in the polarity opposite to the toner particles 6 by the frictional contacts with the toner particles 6. In the embodiment, the toner particles 6 are negatively charged and the charging particles 8 are positively charged. Consequently, the carrier particle 4 bearing the implanted charging particles 8 retains a charging ability as much as it has when no toner-spent 10 exists thereon. This ensures that the toner particles 6 are well charged in the predetermined polarity and to the desired degree even though the peripheral surfaces of the carrier particles 4 are partially or entirely covered with the toner-spent 10.

As described above, the charging particles 8 are electrically charged in the polarity opposite to that of the toner particles 6.

Figure 10:
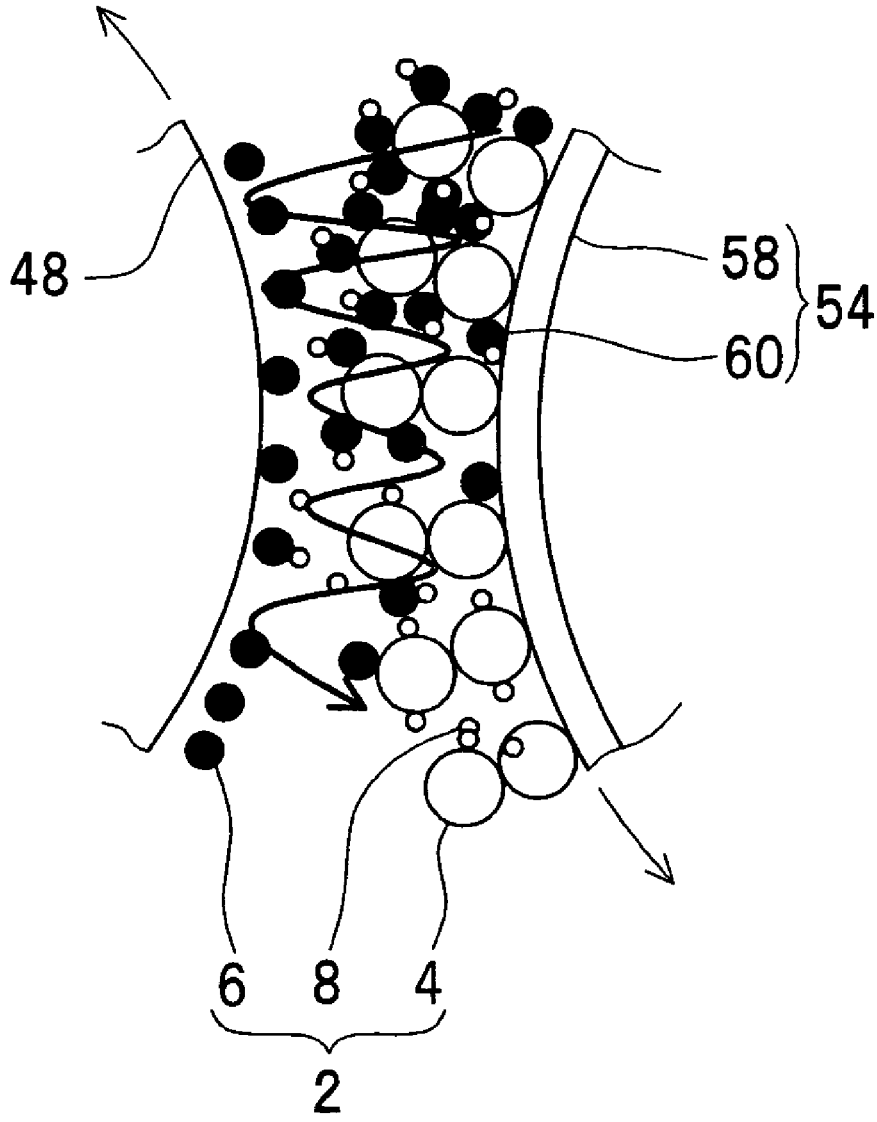
FIG. 10 is a view schematically illustrating a motion of toner and charging particles in a supplying and collecting region.

Therefore, as shown in FIG. 10, in the supplying and collecting region 88 the toner particles 6 are forced from the sleeve 60 to the developing roller 48 due to the electric field formed between the developing roller 48 and the sleeve 60. The charging particles 8 separated from the toner particles 6 are quickly supported on the surface of the carrier particles 4 in the developer material. The developer left from the supplying sub-region 90 has a less amount of toner particles 6 since a part of toner particles 6 is transferred to the developing roller 48. This allows the charging particles to be caught easily by the carrier particles in the carrier-rich developer, rather than being transferred onto the developer roller 48 together with the toner particles 6. Also, only a small amount of charging particles, if any, may be transferred to the developing roller 48.

Figure 11:
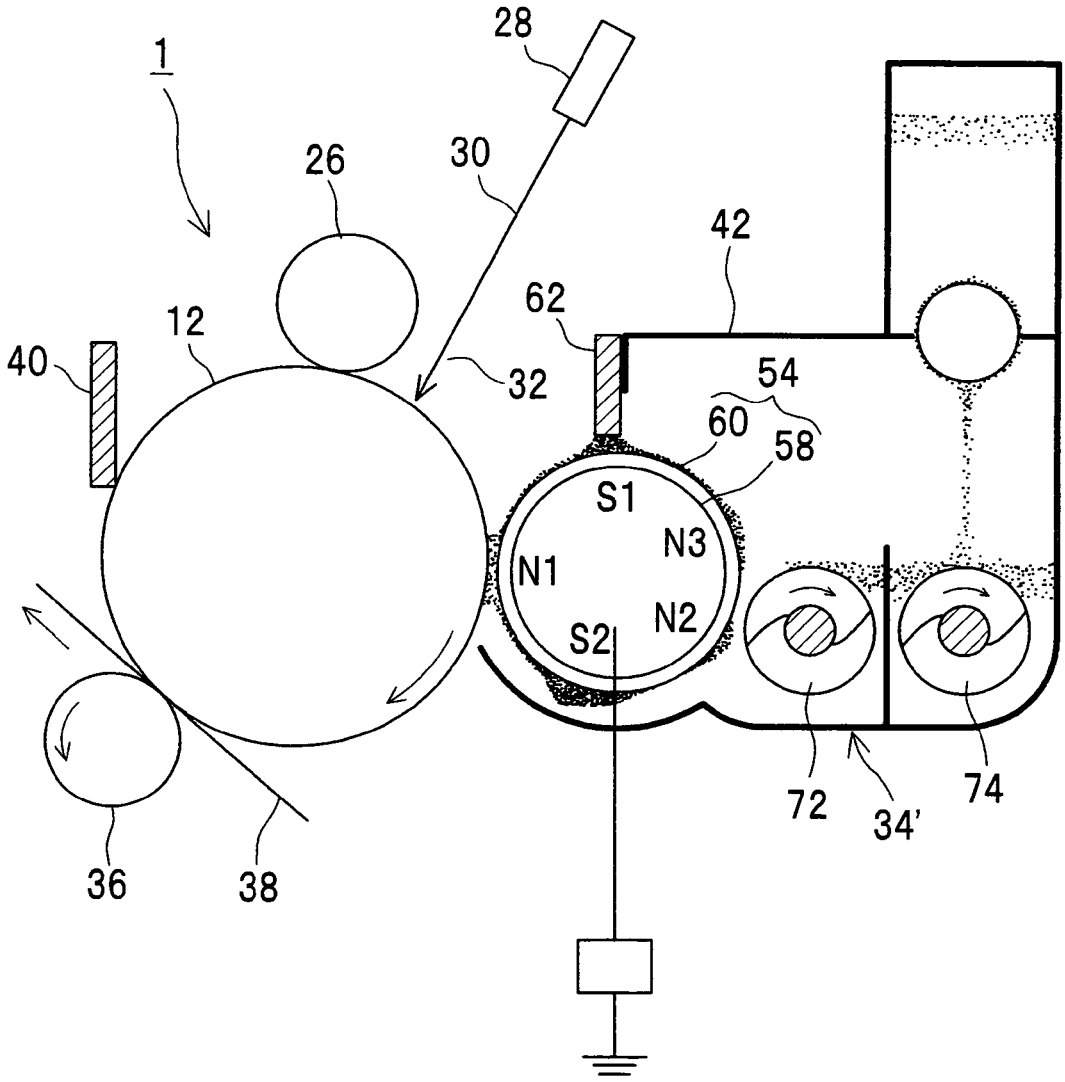
FIG. 11 is a cross sectional view showing another developing device.
Figure 12:
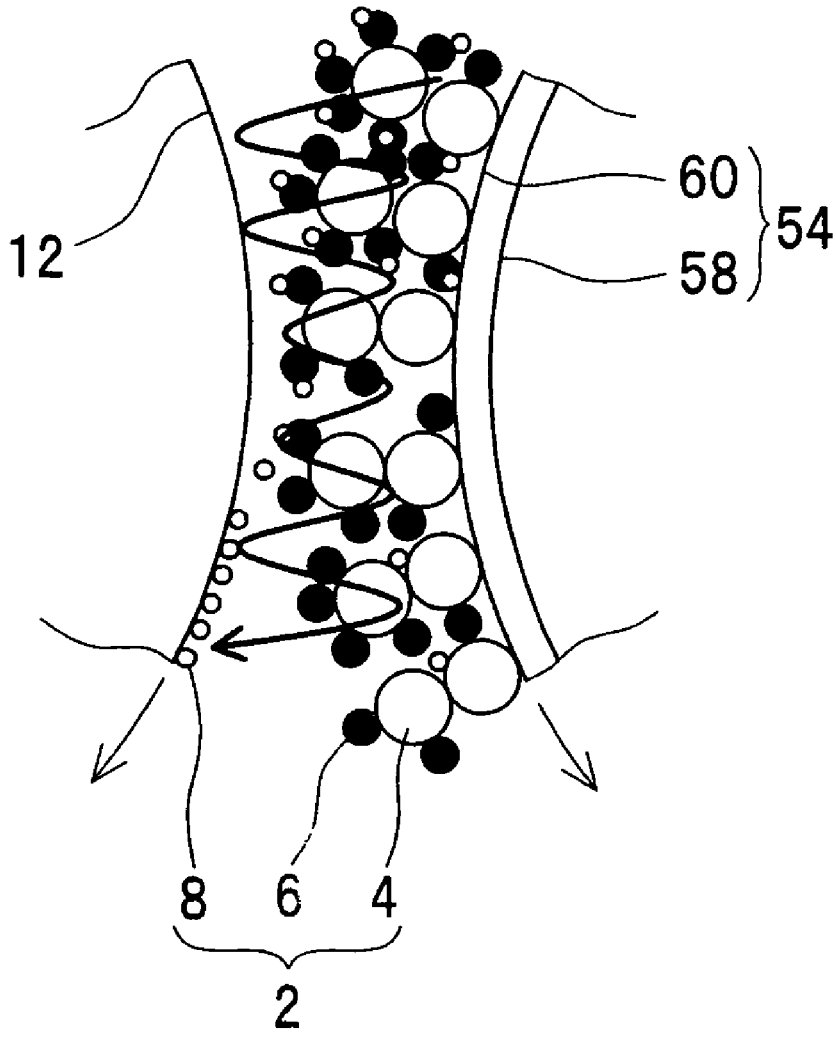
FIG. 12 is a view schematically illustrating a motion of toner and charging particles in a development region of the developing device shown in FIG. 11.

If the charging particles were used for the developing device 34' free from a developing roller as shown in FIG. 11, a different result would occur. Specifically, in operation of this developing device, an electrostatic latent image is formed on the peripheral surface of the photosensitive member 12. The electrostatic latent image has, for example, an electrostatic latent non-image region having a high voltage where a charged voltage is substantially retained and an electrostatic latent image region having a lower voltage where a voltage is decreased by the exposure to light 30 from the exposure device 28. The image and non-image regions pass through the developing region between the photosensitive member 12 and the opposed transporting roller 54, where the negatively charged toner particles 6, for example, adhere to the electrostatic latent image region with the lower voltage, rather than the electrostatic latent non-image region. In this developing, the charging particle 8 has the positive charge which is different from that of toner particles 6. Accordingly, as shown in FIG. 12, a large number of charging particles 8 tend to be attracted and consumed onto the electrostatic latent non-image region of the photosensitive member 12. This in turn means that the number of the charging particles 8 implanted into the peripheral surface of the carrier particles 4 is significantly small compared with the developing device 34 described above, which results in that the carrier particles 4 with toner spent fail to maintain necessary toner-charging abilities.

Further, in the developing device disclosed in JP 2006-308687 A, the charging particles are substantially not retained on toner or carrier particles, i.e., behaving freely, among toner and carrier particles. Also, the charging particles initially introduced into the developing device are charged in a polarity opposite to that of toner particles. This results in that the charging particles are electrically combined with the toner particles and then supplied to the developing roller together with the toner particles and then consumed onto the electrostatic latent non-image region on the photosensitive member, which deteriorates the charging ability of the toner particles. Contrarily, according to the developing device of the present invention, the charging particle 8 separated from the toner particles 6 in the supplying and collecting region 88 are quickly held onto the carrier particles 4 and then stay on the peripheral surface of the sleeve 60, rather than being supplied and consumed onto the photosensitive member 12 through the developing roller 48, which ensures the carrier particles to have a long term, stable toner-charging ability. Unavoidably, a small number of charging particles tend to be consumed onto the developing roller 48, together with toner particles 6, even in the developing device of the present invention. This is not a serious problem because the charging particles 8 are supplied from the supply unit 98 together with the toner as necessary to retain a necessary amount of charging particles in the developing device, which ensures a stable toner-charging property over the long term.

As described above, in the previous embodiment, the toner particles 6 are negatively charged and the carrier particles 4 are positively charged by frictional contacts therebetween. The charging particles 8 provide negative charge to the toner particles by the frictional contacts therewith. In turn, the charging particles are charged into the positive polarity by the contact with toner particles.

The charged polarities of the particles are not restrictive to the present invention. For example, the toner and carrier particles may be charged positively and negatively, respectively, by the frictional contacts therewith, and the charging particles may be charged into the negatively charged by the frictional contacts with the toner particles while imparting positive charge to the toner particles.

5. Materials for Particles

Materials of constituting toner, carrier and charging particles, respectively, will be described below.

Charging Particles

The charging particles used are selected in accordance with the polarity of the charge to be provided to the toner particles. A number-average particle diameter of the charging particle ranges, for example, from 100 to 1,000 nm. When the toner particles to be negatively charged through the frictional contact with the carrier are used, particles to be positively charged through the frictional contact with the toner particles are used as charging particles. Such particles may be composed of inorganic particles such as strontium titanate, barium titanate, and almina, or thermoplastic resins or thermosetting resins such as acrylic resin, benzoguanamine resin, nylon resin, polyimide resin and polyamide resin. A resin composing the particle may contain a positively charged control agent to be positively charged by contact with the toner particles. For a positively charged control agent, for example, nigrosine dyes and quaternary ammonium salt may be used. The charging particle may be composed of a nitrogen-containing monomer. Examples of materials composing the nitrogen-containing monomer include, for example, 2-dimethylaminoethyl acrylate, 2-diethylaminoethyl acrylate, 2-dimethylaminoethyl methacrylate, 2-diethylaminoethyl methacrylate, vinylpyridine, N-vinylcarbazole, and vinylimidazole.

When using toner particles to be positively charged by contact with the carrier, particles to be negatively charged by contact with the toner are used for the charging particles. For those particles, for example, inorganic particles such as silicand titanium oxide, or particles composed of thermoplastic resins or thermosetting resins such as fluororesin, polyolefin resin, silicone resin, polyester resin may be used. A resin composing the charging particle may contain a negatively charged control agent to be negatively charged by contact with the toner particles. For a negatively charged control agent, for example, chromium complex, aluminum complex, iron complex and zinc complex of salicylic acid or naphthol may be used. The charging particle may be copolymers of fluorine-containing acrylic monomers or fluorine-containing methacrylic monomers.

In order to control the electrostatic propensity or the hydrophobicity of the charging particles, the surface of the inorganic particle may be surface treated with, for example, a silane coupling agent, a titanium coupling agent, and a silicon oil. Particularly for providing positive electrostatic propensity for the inorganic particle, the inorganic particle is preferably surface-treated with an amino group-containing coupling agent. For providing negative electrostatic propensity for the particle, the inorganic particle is preferably surface-treated with an fluorine group-containing coupling agent.

Toner Particles

Conventional, commercially available toner particles may be used for the image forming apparatus. Each of the toner particles has a diameter ranging, for example, from about 3 to 15 μm. Other toner particles such as toner particles containing binder resin and coloring agent contained therein, toner particles containing charge control agent or release agent, and toner particles retaining additives thereon may be employed.

The toner particles may be produced by the conventional methods such as a pulverization method, an emulsion polymerization method, and a suspension polymerization method.

Binder Resin

Although not limited, the binder resin used for the toner may be styrenic resins (styrene or homopolymer or copolymer including styrene substitution), polyester resins, epoxy resins, vinyl chloride resin, phenol resin, polyethylene resin, polypropylene resin, polyurethane resin, silicone resin, and any combinations thereof. The binder resin preferably have a softening point of about 80 to 160° C. and a glass transition point of about 50 to 75° C.

Coloring Agent

Conventional, commercially available coloring agents such as carbon black, aniline black, activated carbon, magnetite, benzine yellow, permanent yellow, naphthol yellow, phthalocyanine blue, first sky blue, ultramarine blue, rose bengal, and lake red may be used. Typically, an amount of the coloring agent is preferably 2 to 20 parts by weight for 100 parts by weight of the binder resin.

Charge Control Agent

Conventional, commercially available charge control agents may be used. Specifically, nigrosine dyes, quaternary ammonium salt compounds, triphenylmethane compounds, imidazole compounds, and a polyamine resin, for example, may be used for positively charged toner particles. Azo dyes containing metals such as Cr, Co, Al and Fe, metal salicylate compounds, metal alkylsalicylate compounds, and calixarene compounds, for example, may be used for the negatively charged toner particles. It is preferable to use the charge control agent in an amount 0.1 to 10 parts by weight for 100 parts by weight of binder resin.

Conventional, commercially available release agents may be used. Polyethylene, polypropylene, carnauba wax, Sasol Wax, or mixtures in combination thereof may be used for the release agent. It is preferable to use the release agent in an amount 0.1 to 10 for 100 parts by weight of a binder resin.

Other Additives

A fluidizing agent which accelerates the fluidization of the developer may be added. For the fluidizing agent, inorganic particles such as silica, titanium oxide and aluminum oxide, or resin particles such as acrylic resin, a styrene resin, a silicone resin and a fluororesin may be used. Preferably, materials with hydrophobicity provided by the addition of, for example, silane coupling agent, titanium coupling agent, and silicon oil may be used. It is preferable to add the fluidizing agent in an amount 0.1 to 5 for 100 parts by weight of the toner. The number-average primary particle diameters of the additives are preferably 9 to 100 nm.

Carrier Particles

Conventional, commercially carrier particles such as binder carrier and coated carrier particles may be used. A particle diameter of the carrier is not limited. Preferably, the carrier particle has a diameter of about 15 to 100 μm.

Typically, the binder carrier is formed by dispersing magnetic substance particles in the binder resin, and substances having particles to be positively or negatively charged or the coating layer on the surface may be used for the binder carrier. Charging characteristics such as the polarity of the binder carrier may be controlled by selecting a material of a binder resin, particles having electrostatic propensity, and materials of the surface coating layer.

Examples of the binder resin used for the binder carrier include thermoplastic resins such as vinyl resins typified by polystyrene resin, polyester resins, nylon resins and polyolefin resins, and thermosetting resins such as phenolic resin.

For the magnetic substance particle of the binder carrier, magnetite, spinel ferrite such as g-iron oxide, spinel ferrite containing one or two or more materials of nonferrous metals (Mn, Ni, Mg, Cu, etc.), magnetoplumbite ferrite such as barium ferrite, and particles of iron or alloy, having a oxidation layer in the surface, may be used. The shape of the carrier may be any one of a grain, sphere, and needle. When it is required to highly magnetize the particle, iron base ferromagnetic particle is preferably used. To increase the chemical stability, it is preferable to use magnetite, spinel ferrite including g-iron oxide, and ferromagnetic particles of magnetoplumbite type ferrite such as barium ferrite. By appropriately selecting the materials or the content of ferromagnetic particles, a magnetic resin carrier having desired magnetization may be obtained. The magnetic substance particle is properly added to the magnetic resin carrier in an amount 50 to 90 percent by weight.

For the surface coating material of the binder carrier, for example, a silicone resin, an acrylic resin, an epoxy resin, and a fluororesin may be used. The ability of the carrier to provide charges may be improved by coating the surface of the carrier with these resins and curing these resins to form a coat layer.

The fixation of a particle having electrostatic propensity or a conductive particle to the surface of the binder carrier particle is performed by uniformly mixing, for example, magnetic resin carriers and particles to allow these particles to adhere to the surface of the magnetic resin carrier, and then implanting the particle into the magnetic resin carrier by giving mechanical or thermal shock. In this case, the particle is not completely embedded in the magnetic resin carrier and it is fixed to the surface in such a way that a part of the particle protrudes through the surface of the magnetic resin carrier. An organic insulating or an inorganic insulating material is used for the particle having electrostatic propensity. As a specific organic insulating material, organic insulating particles such as polystyrene, styrenic copolymer, acrylic resin, various acryl copolymers, nylon, polyethylene, polypropylene, fluororesin, and crosslinked products thereof may be used. The ability to provide charges and the charged polarity may be adjusted by, for example, a material of a particle having electrostatic propensity, a polymerization catalyst, and a surface treatment. As an inorganic insulating material, inorganic particles to be negatively charged such as silicand titanium dioxide, and inorganic particles to be positively charged such as strontium titanate and alumina may be used.

The coated carrier particle is made by coating a carrier core particle formed by a magnetic substance with resin, and particles having electrostatic propensity to be positively or negatively charged may be fixed to the surface of the carrier as with the binder carrier. Charging characteristics such as the polarity of the coated carrier may be controlled by selecting materials of a surface coating layer or particles having electrostatic propensity. As a coating resin, the same resin as a binder resin of the binder carrier may be used.

A mixing ratio of the toner and carrier particles may be adjusted so as to attain a desired amount of charge of toner particles, and a rate of toner is 3 to 50 percent by weight with respect to the total amount of the toner and the carrier, and preferably 6 to 30 percent by weight.

Experiment A

Advantages obtained by using the charging particle were examined using an image forming apparatus having developing device of FIG. 1 and an image forming apparatus including developing device of FIG. 11. Toner (toner particles) "A" not carrying the charging particles and toner (toner particles) "B" carrying the charging particles were prepared for experiments.

Toner "A"

The method of producing the toner "A" is as follows. To 100 parts by weight of a toner base material, prepared by a wet granulating method, having a volume average particle diameter of about 6.5 μm, a plurality of additives (0.2 parts by weight of first hydrophobic silica, 0.5 parts by weight of second hydrophobic silicand 0.5 parts by weight of hydrophobic titanium oxide) were added. Next, the toner base material to which the additives had been added was stirred with Henschel mixer manufactured by Mitsui Mining Co., Ltd. to cause the additives to adhere to the surface of the toner base material to obtain a negatively charged toner "A". A rotation speed of the mixer was 40 m/sec and a stirring duration was 3 minutes. The first hydrophobic silica was obtained by surface treating silica (No. 130, produced by Nippon Aerosil Co., Ltd.) having a number-average primary particle diameter of 16 nm with hexamethyldisilazane (HMDS) of a hydrophobizing agent. The second hydrophobic silica was obtained by surface treating silica (No. 90, produced by Nippon Aerosil Co., Ltd.) having a number-average primary particle diameter of 20 nm with HMDS. Hydrophobic titanium oxide was obtained by surface treating anatase type titanium oxide having a number-average primary particle diameter of 30 nm with isobutyltrimethoxysilane, a hydrophobizing agent, in a water base wet ambient.

Toner "B"

A producing method of toner "B" is as follows. Strontium titanate having a number-average particle diameter of 350 nm was added to the toner "A" as a charging particle. An amount of the charging particle to be added was 2 for 100 parts by weight of the toner base material particle contained in the toner "A". Next, toner "A" to which the charging particles had been added was stirred with Henschel mixer manufactured by Mitsui Mining Co., Ltd. to cause the charging particle to adhere to the surface of the toner to prepare toner "B". A rotation speed of the mixer was 40 m/sec and a stirring duration was 3 minutes.

Carrier

A carrier (carrier particles) for Bizhub C350 manufactured by Konica Minolta Business Technologies, Inc. was used for experiments. This carrier is a coated carrier formed by coating a carrier core particle formed of a magnetic substance with an acrylic resin.

Example 1

Figure 13:
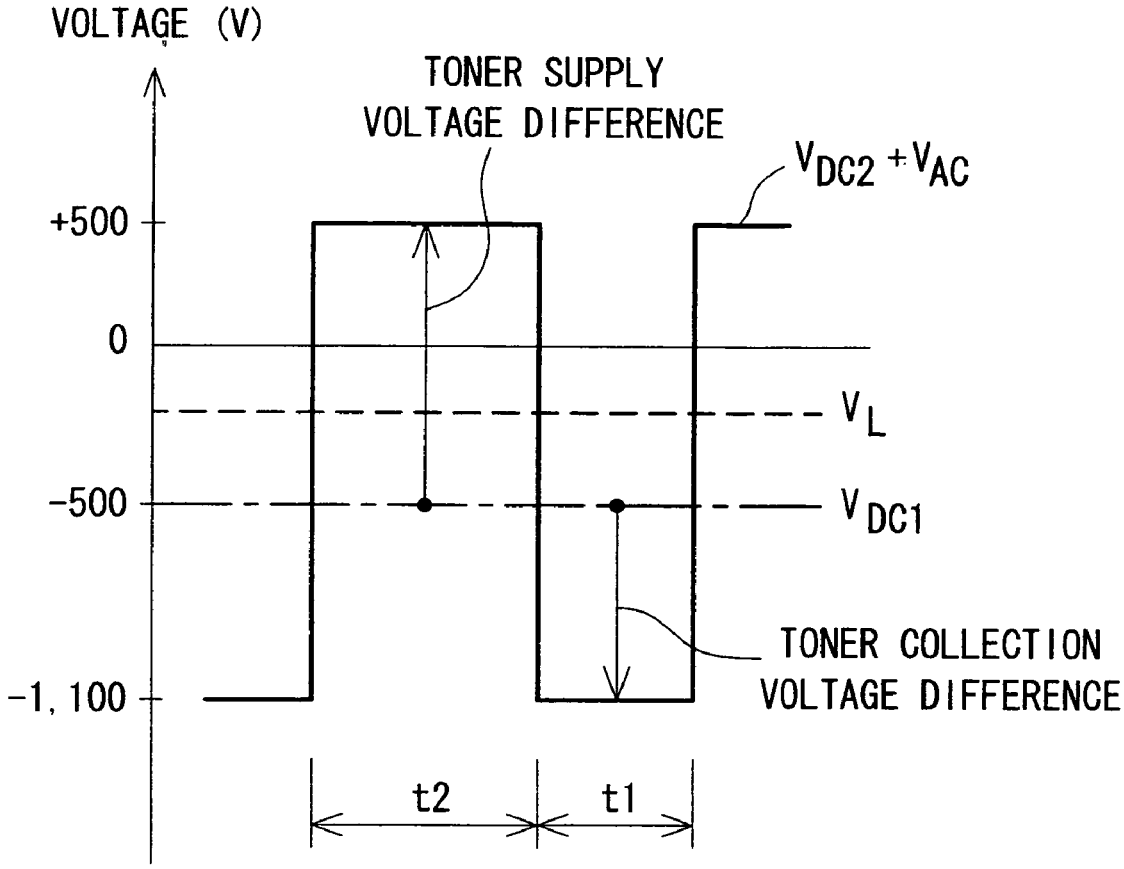
FIG. 13 is a view showing a waveform of a voltage supplied to a sleeve and a developing roller in the developing device.

As developing device, developing device of constitution shown in FIG. 1 was used. As a developer, the carrier and the toner "B" described above were used. A ratio of the toner in the developer was adjusted to 8 percent. The ratio of the toner is a ratio of the total weight of the toner and an additive including the charging particle to the weight of the whole developer. As electric field forming unit, a constitution shown in FIG. 9 was employed, a DC voltage $V_{DC2}$: −500 V was applied to a transporting roller, and a DC voltage $V_{DC1}$: −300 V and an alternating voltage were applied to a developing roller. The alternating voltage was a rectangular wave in which a frequency was 2 kHz, an amplitude $V_{P\text{-}P\ was}$ 1600 volts, a minus duty ratio (toner collection duty ratio) was 40 percent, and a plus duty ratio (toner supply duty ratio) was 60 percent (see FIG. 13). Therefore, a supply voltage difference (toner supply voltage), which biases the negatively charged toner from the sleeve to the developing roller, is 1000 volts, and a collection voltage difference (toner collection voltage), which biases the toner from the developing roller to the sleeve, is 600 volts.

As a developing roller, an aluminum roller, the surface of which is anodized, was used. A supply collection gap between the developing roller and the sleeve was set at 0.3 mm. Thereby, a toner supply electric field formed between the developing roller and the sleeve was $3.3\times10^6$ V/m (=1000 V/0.3 mm). The regulating gap between the regulating plate and the sleeve was set at 0.4 mm so that the magnetic brush on the sleeve comes into contact with the peripheral surface of the developing roller. The developing device was constructed in such a way that the developing roller and the sleeve rotate in the same direction, and that the toner on the developing roller moves in the direction opposite to the direction of transportation of the developer on the sleeve in the supplying and collecting region. A charged voltage of the photosensitive member was −550 volts and a voltage of a non-image region and an image region of the electrostatic latent image formed on the photosensitive member was −60 volts. The development gap between the photosensitive member and the developing roller was set at 0.15 mm.

Comparative Example 1

The same developer as that in Example 1 was used. As developing device, developing device of the constitution shown in FIG. 11 was used. A rectangular wave in which an amplitude was 1400 volts, a DC voltage was −300 V, a minus duty ratio was 50 percent, and a frequency was 4 kHz was applied to the sleeve. The development gap between the sleeve and the photosensitive member was set at 0.3 mm. Other conditions were the same as those for Example 1.

Comparative Example 2

The toner "A" not carrying the charging particles was used in place of the toner "B" having the charging particles. Other conditions were the same as those for Example 1.

Evaluation

Figure 14:
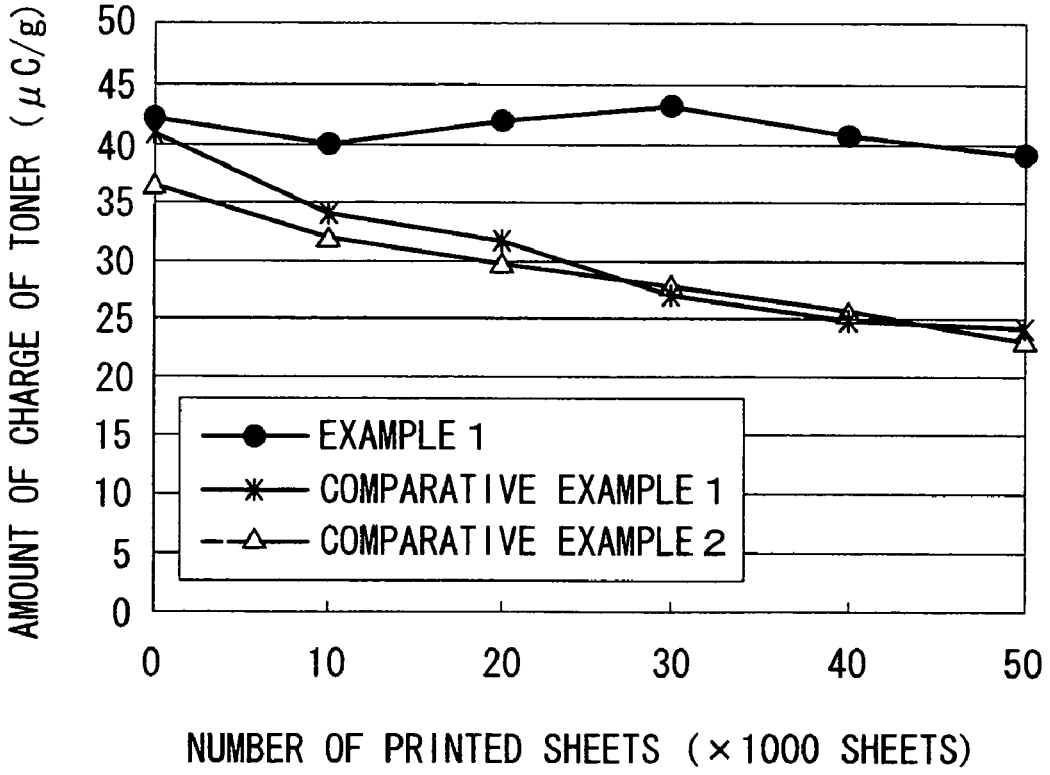
FIG. 14 is a graph showing a relationship between the number of printed sheets and an amount of electric charge of a toner.

Using an image forming apparatus formed by modifying a copying machine Bizhub C350 manufactured by Konica Minolta Business Technologies, Inc., an original image having an image region percentage of 5 percent was printed in 50,000 sheets in different conditions. The developer in the equipment was sampled every 10000 sheets of printing and an amount of charge of the toner was measured. The results of measurements are plotted on a graph of FIG. 14. As is apparent from the graph, in Example 1, an amount of charge of the toner remained almost constant in spite of an increase in the number of printing. On the other hand, in comparative examples 1, 2, an amount of charge of the toner decreased with the increase in the number of printing.

Figure 15A:
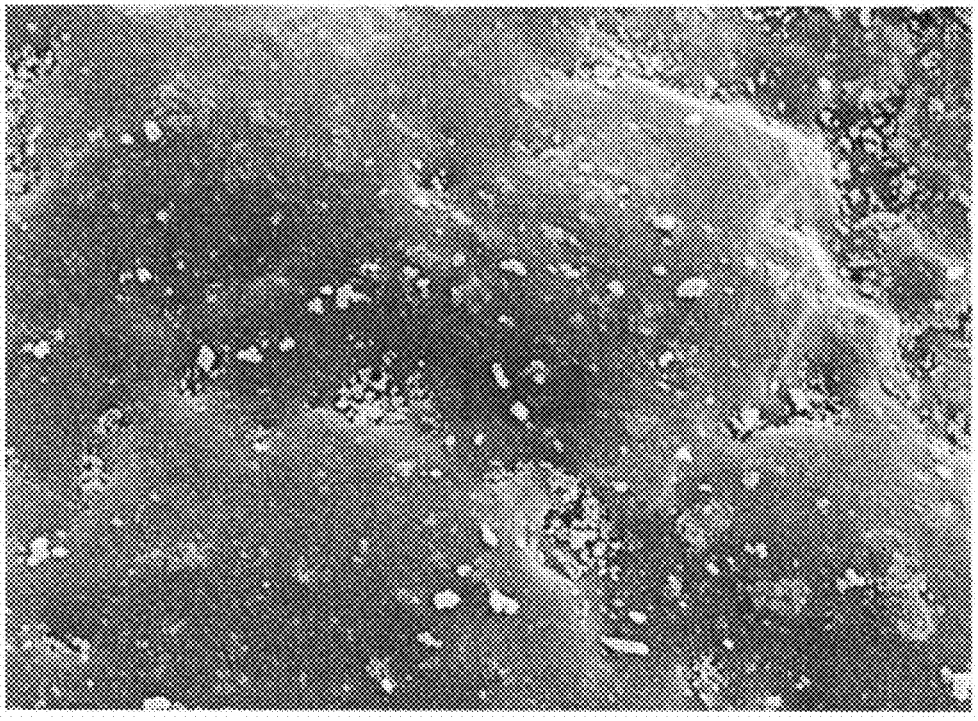
FIG. 15A is an enlarged photograph of a surface portion of the carrier particle in which charging particles are implanted.
Figure 15B:
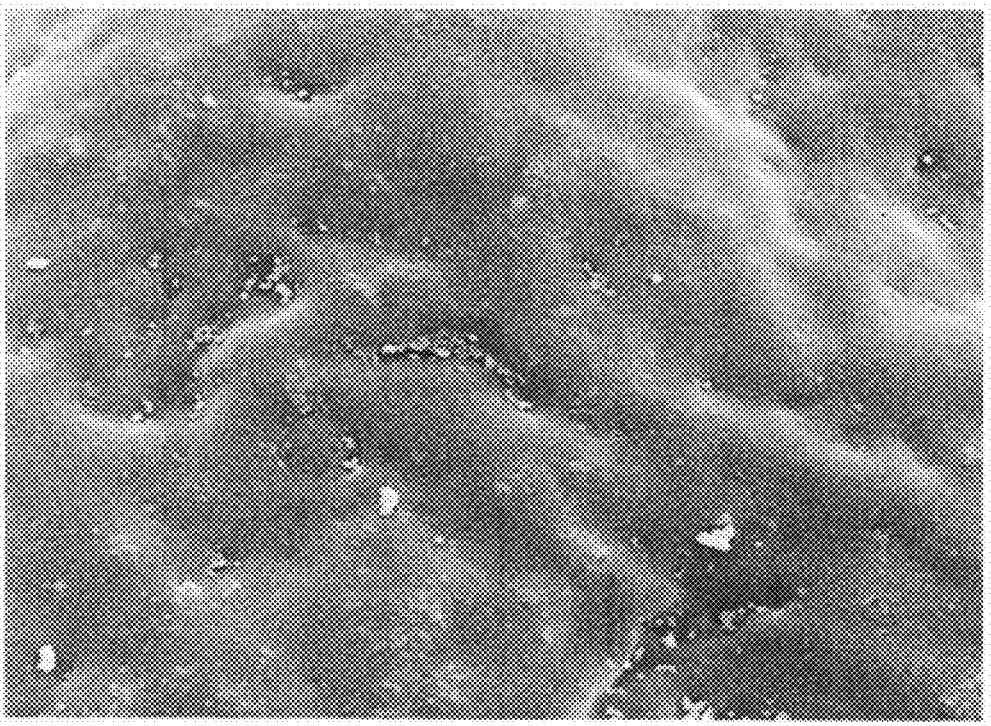
FIG. 15B is an enlarged photograph of a surface portion of the carrier particle in which no charging particle is not implanted.
Figure 15C:
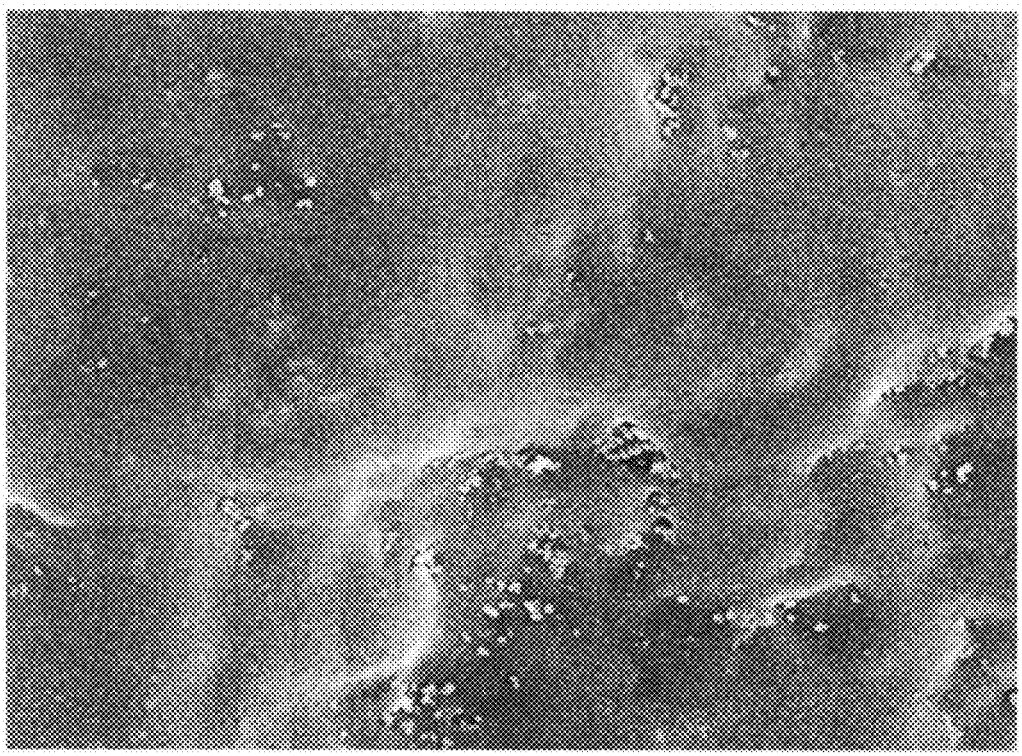
FIG. 15C is an enlarged photograph of a surface portion of the carrier particle in which no charging particle is not implanted.

After the completion of printing of 50,000 sheets, the carrier was separated from the developer and the surface of the carrier was observed with a scanning electron microscope. FIG. 15A is an enlarged photograph of the carrier separated from the developer including the toner "B" having the charging particles. A small particle found in the photograph was analyzed with X-ray photoelectron spectroscopy (Electron Spectroscopy for Chemical Analysis), and strontium, which is a principal component of the charging particle, was detected. The result of this detection attested that the charging particle had been implanted into the surface of the carrier. FIG. 15B and FIG. 15C are enlarged photographs of the carrier separated from the developer including the toner "B" not having the charging particle. As is apparent in comparison with FIG. 15A, there was little fine particles at the surface of the carrier.

Charged Polarity of Charging Particle

Figure 16:
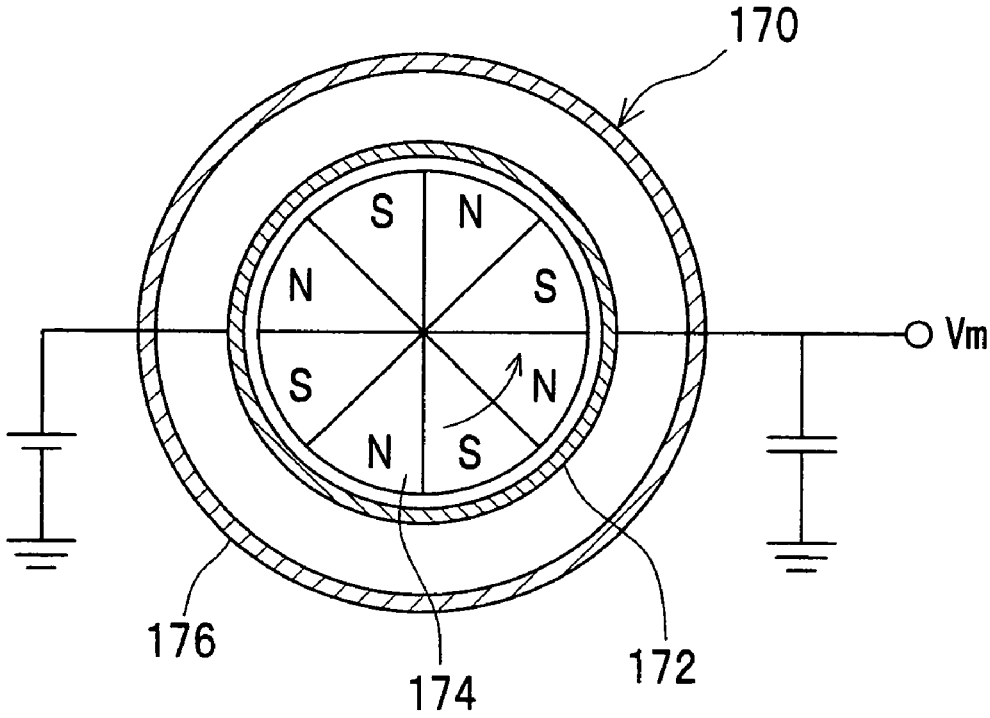
FIG. 16 is a sectional view of an apparatus for testing charged conditions of the charging particle.

The charged polarity of the charging particle was confirmed using an experimental apparatus 170 shown in FIG. 16. The experimental apparatus 170 has a stationary cylindrical member 172, a magnet roller 174 rotatably arranged within the cylindrical member 172, and an outer cylinder 176 surrounding the magnet roller 174. An electric field, which does not electrically bias the negatively charged toner from the cylindrical member 172 toward the outer cylinder 176, that is, biases the charging particle having the polarity opposite to the toner from the cylindrical member 172 toward the outer cylinder 176, was applied to a region between the cylindrical member 172 and the outer cylinder 176. And, after stirring the developer formed of the toner "B" including the charging particle and the carrier, the stirred developer was held on the peripheral surface of the cylindrical member 172 and the magnet roller 174 was rotated. Consequently, strontium titanate of the charging particle subjected to an electric field's biasing force from the cylindrical member 172 toward the outer cylinder 176 was separated and departed from the developer and found to exist on the inner surface of the outer cylinder 176. Thereby, it is evident that strontium titanate becomes charged in a polarity (positively) opposite to that of the toner.

Conclusion

From the experiment described above, it was found that strontium titanate to be charged in an opposite polarity to that of the toner adheres to the surface of the carrier in the developing device, and thereby the reduction in the ability of the carrier to cause the toner to be charged is supplemented and the amount of charge of the toner is kept at a value required for a long period of time.

Experiment B

Using the toner "B" used in Example 1 and developing device of FIG. 1, the intensity of an electric field acting on the developer between the sleeve and the developing roller was changed to print an image having an image region percentage of 5 percent in 50,000 sheets, and then the reduction in the amount of charge of the toner held on the surface of the developing roller was measured. The conditions and results of experiments are shown in Tables 1 and 2.

As is apparent from Table 1, when a low toner supply electric field, a direct electric field, of $1\times10^6$ V/m or less is formed in the supplying and collecting region (experiments 1, 13), relatively large reductions in amount of charge were found. However, even in such a condition, image quality which has practically no problem was obtained. The reason for the reduction in amount of charge may be that, since an electric field to separate the charging particle from the toner is low, the charging particle moves with the toner and therefore an amount of the charging particle adhering to the surface of the carrier is small and adequate toner-charging performance was not attained. Therefore, when the direct electric field is employed, it is preferable to form a toner supply electric field of $1\times10^6$ V/m or more in the supplying and collecting region.

As is apparent from the comparisons of the results between experiments 1, 13 and experiment 4, and between experiment 2 and experiments 8, 9, it is evident that, when the pulsating field acts on the supplying and collecting region, higher toner-charging performance may be attained even though its mean electric field is equal to that of direct electric field. The reason for this is that two biasing forces, acting in the direction opposite to each other, alternately act on the toner and the charging particle with the biasing force on the toner opposite to that on the charging particle by the pulsating field, and thereby the charging particle is separated from the toner efficiently. Accordingly, it may be the that the formation of the pulsating field is more preferable than the formation of the direct electric field in the supplying and collecting region. When the pulsating field is used, it is thought that a toner supply electric field is preferably about $2.5\times10^6$ V/m or more.

TABLE 1

| | Condition of supplying and collecting section | | | | | |
|---|---|---|---|---|---|---|
| No. of experiment | Supply collecing gap | Kinds of electric field acting | Toner supply duty | Toner supply voltage difference | Toner collection voltage difference | Toner supply electric field (charging particle collection) |
| 1 | 0.30 mm | Direct electric field | — | 200 V | — | 6.7E+05 V/m |
| 2 | 0.30 mm | Direct electric field | — | 400 V | — | 1.3E+06 V/m |
| 3 | 0.30 mm | Direct electric field | — | 600 V | — | 2.0E+06 V/m |
| 4 | 0.30 mm | Vibrating electric field | 30% | 600 V | 0 V | 2.0E+06 V/m |
| 5 | 0.30 mm | Vibrating electric field | 30% | 800 V | 0 V | 2.7E+06 V/m |
| 6 | 0.30 mm | Vibrating electric field | 30% | 1000 V | 0 V | 3.3E+06 V/m |
| 7 | 0.30 mm | Vibrating electric field | 50% | 1000 V | 0 V | 3.3E+06 V/m |
| 8 | 0.30 mm | Vibrating electric field | 50% | 1000 V | 150 V | 3.3E+06 V/m |
| 9 | 0.30 mm | Vibrating electric field | 50% | 1000 V | 300 V | 3.3E+06 V/m |
| 10 | 0.30 mm | Vibrating electric field | 70% | 1000 V | 450 V | 3.3E+06 V/m |
| 11 | 0.30 mm | Vibrating electric field | 70% | 1000 V | 600 V | 3.3E+06 V/m |
| 12 | 0.30 mm | Vibrating electric field | 70% | 1000 V | 750 V | 3.3E+06 V/m |
| 13 | 0.45 mm | Direct electric field | — | 400 V | — | 8.9E+06 V/m |
| 14 | 0.45 mm | Direct electric field | — | 600 V | — | 1.3E+06 V/m |
| 15 | 0.45 mm | Vibrating electric field | 50% | 1250 V | 0 V | 2.8E+06 V/m |
| 16 | 0.45 mm | Vibrating electric field | 50% | 1250 V | 200 V | 2.8E+06 V/m |

TABLE 1-continued

| No. of experiment | Condition of supplying and collecting section: Toner collecting electric field (charging particle supply) | Average electric field (toner supply→+) | Toner transportation amount on developing roller | Initial to 50 K Reduction in charge amount | Rating |
|---|---|---|---|---|---|
| 1 | — | 6.7E+05 V/m | 2.5 g/m$^2$ | 12.6 μC/g | C |
| 2 | — | 1.3E+06 V/m | 4.6 g/m$^2$ | 9.2 μC/g | B |
| 3 | — | 2.0E+06 V/m | 7.5 g/m$^2$ | 6.3 μC/g | B |
| 4 | 0.0E+00 V/m | 6.0E+05 V/m | 2.7 g/m$^2$ | 10.6 μC/g | C |
| 5 | 0.0E+00 V/m | 8.0E+05 V/m | 3.2 g/m$^2$ | 4.9 μC/g | A |
| 6 | 0.0E+00 V/m | 1.0E+06 V/m | 4.2 g/m$^2$ | 0.4 μC/g | A |
| 7 | 0.0E+00 V/m | 1.7E+06 V/m | 5.1 g/m$^2$ | 2.2 μC/g | A |
| 8 | 5.0E+05 V/m | 1.4E+06 V/m | 4.8 g/m$^2$ | 2.0 μC/g | A |
| 9 | 1.0E+06 V/m | 1.2E+06 V/m | 4.3 g/m$^2$ | 0.8 μC/g | A |
| 10 | 1.5E+06 V/m | 1.9E+06 V/m | 6.1 g/m$^2$ | 2.2 μC/g | A |
| 11 | 2.0E+06 V/m | 1.7E+06 V/m | 5.6 g/m$^2$ | 2.0 μC/g | A |
| 12 | 2.5E+06 V/m | 1.6E+06 V/m | 5.2 g/m$^2$ | 0.8 μC/g | A |
| 13 | — | 8.9E+06 V/m | 2.9 g/m$^2$ | 11.2 μC/g | C |
| 14 | — | 1.3E+06 V/m | 4.3 g/m$^2$ | 8.1 μC/g | B |
| 15 | 0.0E+00 V/m | 1.4E+06 V/m | 4.4 g/m$^2$ | 4.4 μC/g | A |
| 16 | 4.4E+05 V/m | 1.2E+06 V/m | 4.1 g/m$^2$ | 3.8 μC/g | A |

TABLE 2

| Ranking criteria | |
|---|---|
| Rank | Reduction in charge amount |
| A (excellent) | <5 μC/g |
| B (good) | 5-10 |
| C (moderate) | 10-15 |
| D (bad) | 15 or more |

Experiment C

Comparative Example 3

Figure 17:
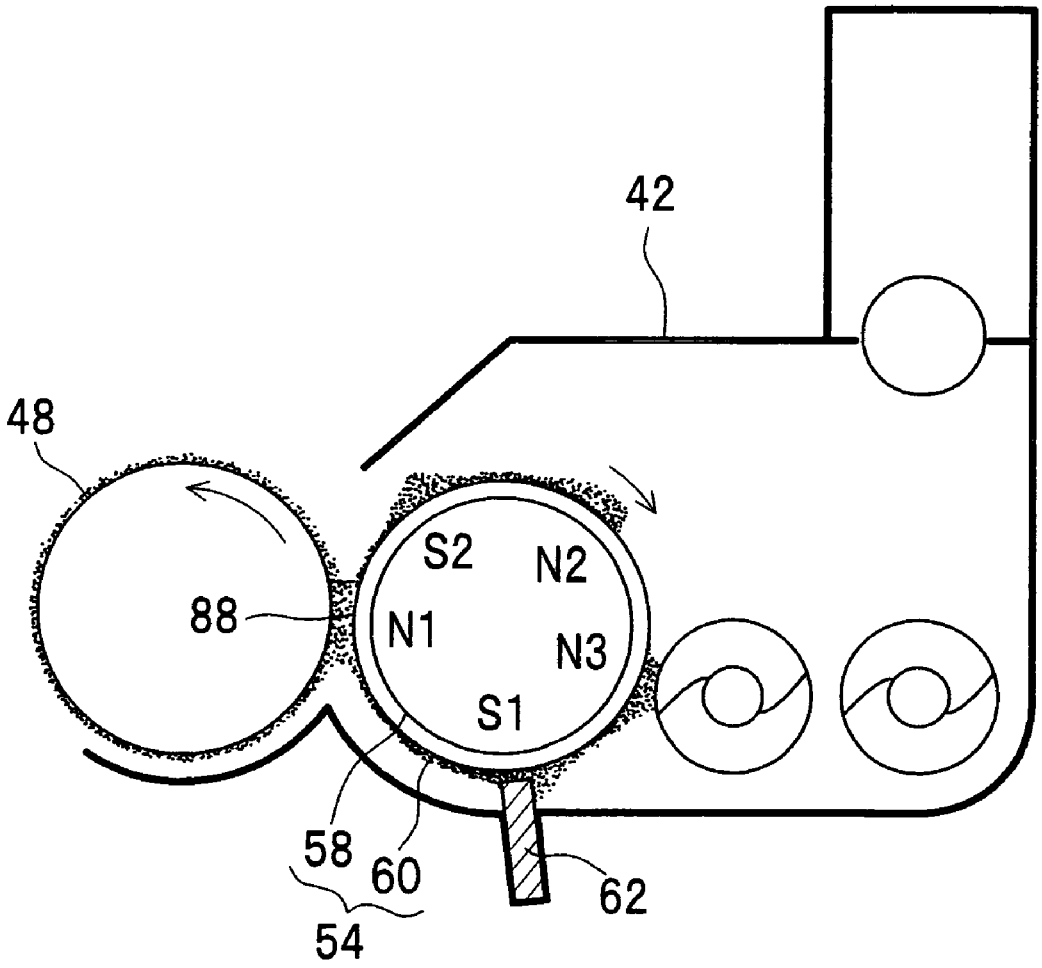
FIG. 17 is a sectional view of developing device of another embodiment.

Using the developing device of FIG. 1 and the developing device of FIG. 17, an image having an image region percentage of 5 percent was printed in 50,000 sheets, and the reduction in the amount of charge of toner and the occurrence of image memories were investigated. The developing device of FIG. 17 is different from the developing device of FIG. 1 in the rotation direction of the sleeve 60, the arrangement of a magnetic pole in the magnet 58 and the position of the regulating plate 62. The results are shown in Table 3.

TABLE 3

| | Developing device of FIG. 1 | Developing device of FIG. 17 |
|---|---|---|
| Reduction in charge amount | 3.0 μC/g | 9.7 μC/g |
| Presence or absence of image memory | None | Present |

As shown in Table 3, it was verified that the developing device of FIG. 17 was inferior in the reduction in the charge amount of toner and the image memories to that of FIG. 1. The difference in moving directions of the sleeve and the developing roller, moving in the development region, is thought to have caused distinct difference between both developing device concerning the reduction in the charge amount of toner and the image memories. Specifically, while the sleeve and the surface of the developing roller move in the direction opposite to each other in the development region in the developing device of FIG. 1, the sleeve and the surface of the developing roller move in the same direction in the developing device of FIG. 17. Therefore, in the developing device of FIG. 1, the surface section of the developing roller passes through the collecting region at first, and there the toner not having contributed to the development is collected to a magnetic brush of the sleeve. At this time, the magnetic brush is already depleted of the toner in the supply region by the developing roller to become a state of less toner and, the magnetic brush in a state of less toner collects the toner efficiently in the next collecting region. Accordingly, since all or most of the toner is replaced in the developing roller having passed through the supplying and collecting region, the image memories do not occur. On the other hand, in the developing device of FIG. 17, the magnetic brush reaching the supplying and collecting region comes into contact with the developing roller. At this time, since the toner sufficiently adheres to the magnetic brush, an amount of the toner to shift from the sleeve to the developing roller upstream the supplying and collecting region is small and relatively much toner adheres to the magnetic brush having passed the supplying and collecting region. Accordingly, the magnetic brush to which relatively much toner adheres downstream the supplying and collecting region cannot collect much toner from the developing roller. It is thought that the developing device becomes a state in which image memories remain on the surface of the developing roller.

Thus, there are large difference in the replacement of the toner on the developing roller, that is, the movement of the toner in the supplying and collecting region, between the developing device of FIGS. 1 and 17 and the number of the charging particles, which is separated from the toner based on the movement of the toner, is small, and this condition is thought to appear as the difference in number of the charging particles implanted into the carrier, and by extension the difference in the ability to cause the toner to be charged.

Experiment D

A plurality of toners "C" to "G" were prepared in addition to toner "B", and changes in an amount of charge were investigated. The toners "C" to "G" were obtained by adding charging particles formed of strontium titanate having a number-average particle diameter of 210 nm, 140 nm, 70 nm, 850 nm and 1000 nm to the toner "A" and stirring the resulting mixture. An amount of the charging particle to be added was set at 2 for 100 parts by weight of the toner base material particle. Stirring was performed at a stirring speed of 40 m/sec for 3 minutes using Henschel mixer. Other conditions were the same as Example 1.

Figure 18:
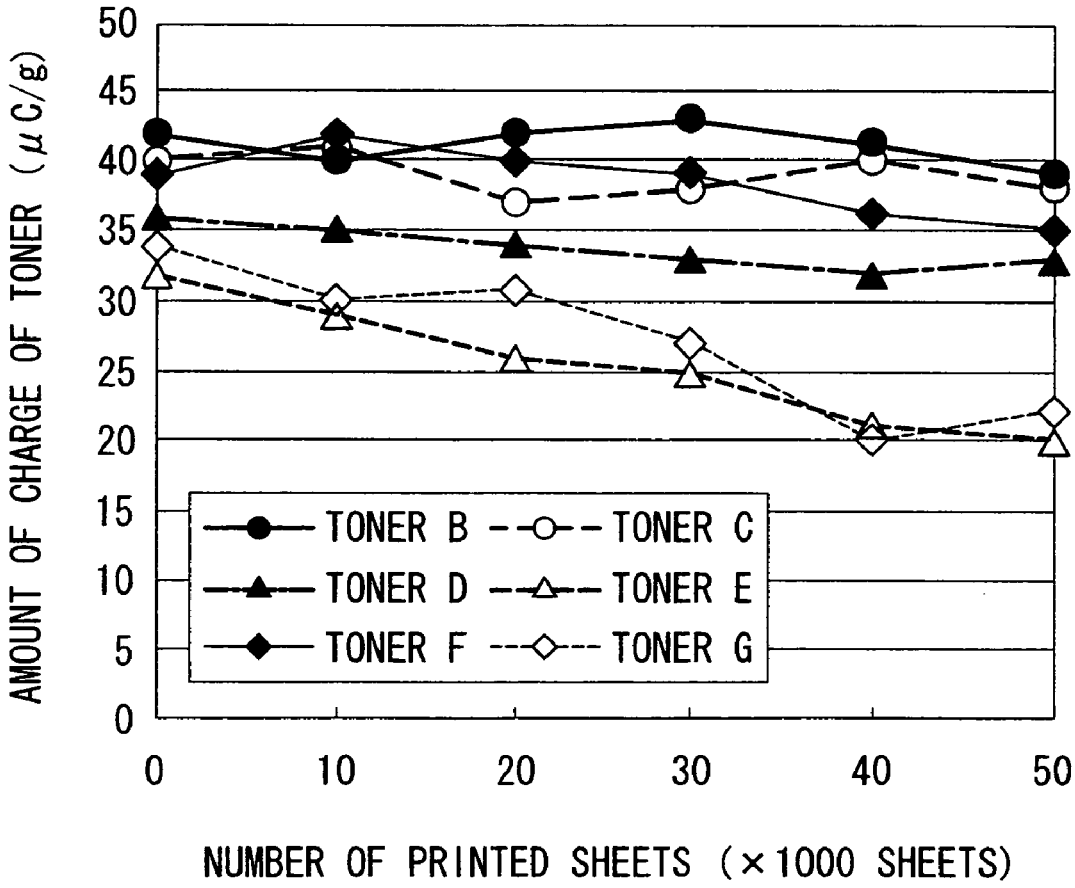
FIG. 18 is a graph showing a relationship between the number of printed sheets and an amount of electric charge of toner particles.

The developing device of FIG. 1 was loaded with the prepared toners "B" to "G", and an image having an image region percentage of 5 percent was printed in 50,000 sheets, and an amount of charge of the toner held on the peripheral surface of the developing roller was measured every 10,000 sheets. The results of measurements are plotted on a graph in FIG. 18. As shown in the graph, with respect to the toners "B", "C", "D", and "F", there was little reduction in an amount of charge, but with respect to the toners "E" and "G", an amount of charge of the toner tends to decrease with the increase in the number of printing. From this result, it is thought that, when the number-average particle diameter is small, the charging particle becomes hard to separate from the toner and consequently an amount of the charging particle adhering to the carrier decreases. Also, it is thought that, when the number-average particle diameter is large, the tendency of the charging particle to be implanted into the carrier is reduced and a toner-charging property cannot be effectively exerted. From these facts, it is conceivable that a particle diameter of the charging particle is preferably within the range of about 100 to about 850 nm.

Experiment E

A plurality of toners "H" to "K" were prepared in addition to toner "B", and changes in an amount of charge of toner were investigated. The toners "H" to "K" were obtained by adding charging particles formed of titanium oxide having a number-average particle diameter of 150 nm, alumina having a number-average particle diameter of 200 nm, barium titanate having a number-average particle diameter of 500 nm, melamine resin beads having a number-average particle diameter of 200 nm to the toner "A" and stirring the resulting mixture. An amount of the charging particle to be added was set at 2 for 100 parts by weight of the toner base material particle. Stirring was performed at a stirring speed of 40 m/sec for 3 minutes using Henschel mixer. Other conditions were the same as Example 1.

Figure 19:
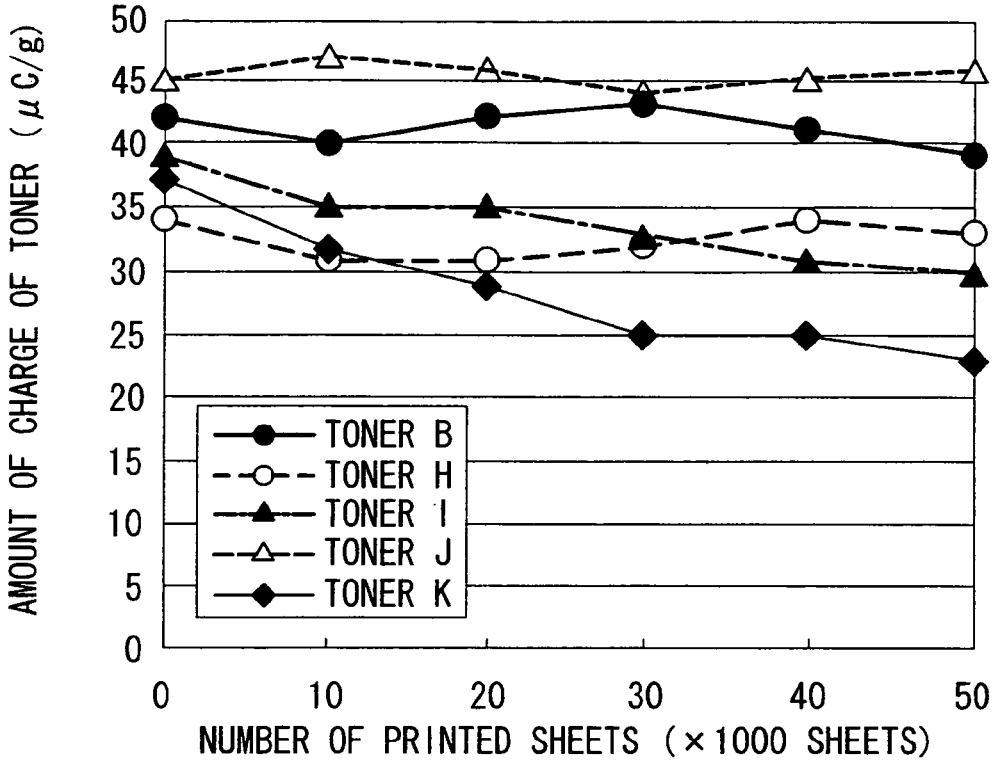
FIG. 19 is a graph showing a relationship between the number of printed sheets and an amount of electric charge of toner particles.

The developing device of FIG. 1 was loaded with the prepared toners "H" to "K", and an image having an image region percentage of 5 percent was printed in 50,000 sheets, and an amount of charge of the toner held on the peripheral surface of the developing roller was measured every 10,000 sheets. The results of measurements are plotted on a graph in FIG. 19. As shown in the graph, with respect to the toner "B" to which strontium titanate was added, the toner "J" to which barium titanate was added, and the toner "H" to which titanium oxide was added, there was little reduction in an amount of charge of the toner. With respect to the toner I to which alumina was added, an amount of charge of the toner was reduced a little. With respect to the toner "K" to which melamine resin beads were added, the reduction in an amount of charge of the toner was the largest.

A saturation amount of charge of a material itself is thought to have caused the variations in the amounts of charge thus produced due to the difference between materials composing the charging particle. That is, when a charge amount which the particle may bear is small, the particle is saturated early and its saturated amount of charge is insufficient for causing the toner to be charged to the required extent, but when a charge amount which the particle may bear is large, the particle charged to a saturation state can cause the toner to be charged to the required extent.

An amount of charge which the particle may bear is proportional to the dielectric constant of a material composing the particle. The dielectric constants of the materials of the charging particle described above are shown in the following Table 4 together with the results of evaluations of the electrostatic propensity obtained in experiment E. From this Table, it is evident that the dielectric constant of the charging particle to be added to the toner is preferably 8.5 or more.

TABLE 4

| Toner | Material of charging particle | Dielectric constant | Evaluation of electrostatic propensity |
|---|---|---|---|
| B | strontium titanate | 332 | B |
| H | titanium oxide | 100 | B |
| I | alumina | 8.5 | C |
| J | barium titanate | 1,200 | B |
| K | melamine resin | 5 | D |

Experiment F

Comparative Example 4

Figure 20:
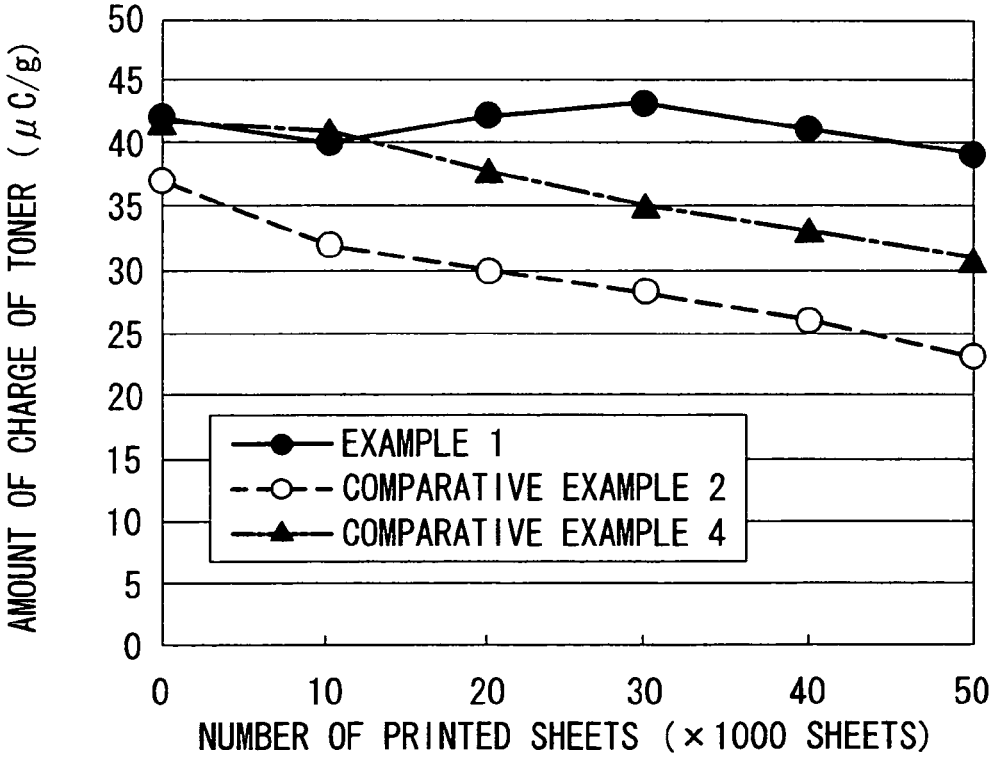
FIG. 20 is a graph showing a relationship between the number of printed sheets and an amount of electric charge of toner particles.

The developing device was loaded with a developer including the charging particles and a container of a toner supply section was loaded with the toner not including the charging particles, and an image having an image region percentage of 5 percent was printed in 50,000 sheets, and an amount of charge of the toner held on the developing roller was measured every 10,000 sheets. The results of measurements are plotted on a graph in FIG. 20 together with the results of Example 1 and comparative example 2. As shown in the graph in FIG. 20, in comparative example 4, there was not reduction in an amount of charge before the charging particles initially charged into the developing device were consumed (before printing about 10000 sheets), but thereafter an amount of charge of the toner decreased with the increase in the number of printing. After the completion of printing of 50,000 sheets, the carrier was sampled from the developer and the surface of sample was observed with a scanning electron microscope. Consequently, strontium titanate was not observed at the surface of the carrier in contrast to the photograph of FIG. 15A. It is evident from this experiment that it is desired to include the charging particles in the toner for supply in the developing device with a toner supply mechanism from the fact that even though the developing device is loaded with a developer including the charging particles, if the charging particle is not replenished after this loading, the ability of the carrier to cause the toner to be charged is deteriorated gradually.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A developing apparatus for visualizing an electrostatic latent image on an electrostatic latent image bearing member by using a developer including toner and carrier particles, comprising:

the developer including toner and carrier particles, the toner and carrier particles being designed to be electrically charged into opposite, first and second polarities, respectively, by frictional contacts with each other;

a first transport member, a second transport member positioned to oppose to the first transport member across a first region and to the electrostatic latent image bearing member across a second region, a first electric field forming unit capable of forming a first electric field between the first and second transport members to move the toner particles from the first transport member to the second transport member; and a second electric field forming unit capable of forming a second electric field between the second transport member and the electrostatic latent image bearing member to move the toner particles from the second transport member to the electrostatic latent image bearing member and thereby to visualize an electrostatic latent image on the image into a visible image;

wherein the developer further includes charging particles which are releasably retained on surfaces of the toner particles and, once released from the toner particles and then held on surfaces of the carrier particles, function to provide an electric charge of the first polarity to the toner particles by the contact therewith.

2. The developing apparatus according to claim 1, wherein the first electric field forming unit forms a DC electric field to move the toner particles from the first transport member toward the second transport member.

3. The developing apparatus according to claim 1, wherein the first electric field forming unit forms a pulsating electric field to move the toner particles from the first transport member toward the second transport member.

4. The developing apparatus according to claim 2, wherein the first electric field is about $2.5\times10^6$ V/m or more.

5. The developing apparatus according to claim 1, wherein the first transport member has a fixed magnet and a first cylindrical member capable of rotating around the fixed magnet, the second transport member has a second cylindrical member, the first and second cylindrical members are disposed to oppose to each other through the first region, and the first and second cylindrical members are adapted so that peripheral surface portions of the first and second cylindrical members move in opposite directions within the first region.

6. The developing apparatus according to claim 1, wherein a number-average particle diameter of the charging particle ranges from about 100 to about 850 nm.

7. The developing apparatus according to claim 1, wherein a dielectric constant of the charging particle is 8.5 or more.

8. The developing apparatus according to claim 1, wherein the developing device includes a supply unit to supply the charging particles to the developer.

9. An image forming apparatus, comprising:

an electrostatic latent image bearing member; and a developing device for visualizing an electrostatic latent image on the electrostatic latent image bearing member by using a developer including toner and carrier particles;

the developing device including a developer including toner and carrier particles, the toner and carrier particles being designed to be electrically charged into opposite, first and second polarities, respectively, by frictional contacts with each other;

a first transport member, a second transport member positioned to oppose to the first transport member across a first region and to the electrostatic latent image bearing member across a second region, a first electric field forming unit capable of forming a first electric field between the first and second transport members to move the toner particles from the first transport member to the second transport member; and a second electric field forming unit capable of forming a second electric field between the second transport member and the electrostatic latent image bearing member to move the toner particles from the second transport member to the electrostatic latent image bearing member and thereby to visualize an electrostatic latent image on the image into a visible image;

wherein the developer further includes charging particles which are releasably retained on surfaces of the toner particles and, once released from the toner particles and then held on surfaces of the carrier particles, function to provide an electric charge of the first polarity to the toner particles by the contact therewith.

10. A method of charging a developer in an electrophotographic image forming apparatus, comprising:

a first step for preparing a developer, the developer having first toner particles to be transferred to a sheet material to form a visible image, and second and third particles imparting an electric charge of a predetermined polarity to the first toner particles through frictional contacts therewith, the third particles being retained on the first toner particles;

a second step for separating the third particles from the first toner particles;

a third step for holding the third particles separated from the first toner particles on surfaces of the second particles; and a fourth step for imparting the charge of the predetermined polarity to the first toner particles by bringing the third particles held on the second particles into frictional contacts with the first toner particles.

11. The method according to claim 10, wherein the third particles are releasably held on the surfaces of the first toner particles in the first step.

12. The method according to claim 10, wherein in the second step, the first, the second, and the third particles are placed in an electric field so that the third particles are separated from the first toner particles by a force exerted from the electric field.

13. The method according to claim 11, wherein in the third step, the third particles separated from the first toner particles in the second step are held on the second particles by stress acted between the second particles and the third particles.

* * * * *